US007912392B2

(12) United States Patent
Yoshinaga et al.

(10) Patent No.: US 7,912,392 B2
(45) Date of Patent: Mar. 22, 2011

(54) IMAGE FORMING APPARATUS WITH GLOSSY IMAGE PRINTING MODE

(75) Inventors: Hiroshi Yoshinaga, Ichikawa (JP); Shinichi Namekata, Yokohama (JP); Toshiharu Hachisuka, Yokohama (JP); Hiroyuki Kunii, Yokohama (JP); Ippei Fujimoto, Yokohama (JP); Yasunori Ishigaya, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 412 days.

(21) Appl. No.: 12/100,068

(22) Filed: Apr. 9, 2008

(65) Prior Publication Data

US 2008/0253789 A1 Oct. 16, 2008

(30) Foreign Application Priority Data

Apr. 10, 2007 (JP) ..... 2007-103229

(51) Int. Cl.
*G03G 15/20* (2006.01)
*G03G 15/14* (2006.01)
*G03G 15/00* (2006.01)

(52) U.S. Cl. ..... 399/69; 399/390; 399/401; 399/407

(58) Field of Classification Search ..... 399/67–70, 399/390, 401, 407
See application file for complete search history.

(56) References Cited

U.S. PATENT DOCUMENTS 5,572,311 A * 11/1996 Abe et al. ..... 399/127
6,577,840 B2 6/2003 Hachisuka et al.
6,628,916 B2 9/2003 Yasui et al.
6,636,709 B2 10/2003 Furukawa et al.
6,778,790 B2 8/2004 Yoshinaga et al.
6,778,804 B2 8/2004 Yoshinaga et al.
6,785,505 B2 8/2004 Yasui et al.
6,865,363 B2 3/2005 Hachisuka et al.
6,881,927 B2 4/2005 Yoshinaga et al.
6,892,044 B2 5/2005 Yasui et al.
6,957,036 B2 10/2005 Kikuchi et al.
(Continued)

FOREIGN PATENT DOCUMENTS

JP 62-144177 6/1987
(Continued)

OTHER PUBLICATIONS

English translation of JP 01-160469 ("Composite copying machine"—Hiroshi Takahashi, Nov. 7, 1989).*
(Continued)

*Primary Examiner* — David M Gray
*Assistant Examiner* — Joseph S Wong
(74) *Attorney, Agent, or Firm* — Oblon, Spivak, McClelland, Maier & Neustadt, L.L.P.

(57) ABSTRACT

An image forming apparatus includes an image forming part, a fixer including a heating member and a pressure member, a reverse transport part to forward a recording medium transported from the fixer to the image forming part, a toner image sensor to detect presence of a toner image on the recording medium, and a controller. When a glossy image formation mode is selected and no toner image is detected on the recording medium, the image forming part does not form a toner image on the recording medium, the fixer performs a first heating and pressing process and transports the recording medium to the reverse transport part, the reverse transport part transports the recording medium to the image forming part, the image forming part forms a toner image on the recording medium transported from the reverse transport part, and the fixer performs a second heating and pressing process and fixes the toner image thereon.

18 Claims, 6 Drawing Sheets

U.S. PATENT DOCUMENTS

| | | | | |
|---|---|---|---|---|
| 7,010,257 | B2 | 3/2006 | Someya et al. | |
| 7,022,944 | B2 | 4/2006 | Yoshinaga et al. | |
| 7,031,648 | B2 | 4/2006 | Takashi et al. | |
| 7,127,202 | B2 | 10/2006 | Fujita et al. | |
| 7,127,204 | B2 | 10/2006 | Satoh et al. | |
| 7,139,520 | B2 | 11/2006 | Echigo et al. | |
| 7,151,907 | B2 | 12/2006 | Yoshinaga | |
| 7,177,580 | B2 | 2/2007 | Nakafuji et al. | |
| 7,233,762 | B2 | 6/2007 | Kunii et al. | |
| 7,254,362 | B2 | 8/2007 | Kikuchi et al. | |
| 7,269,384 | B2 | 9/2007 | Someya et al. | |
| 7,299,003 | B2 | 11/2007 | Kurotaka et al. | |
| 7,313,353 | B2 | 12/2007 | Satoh | |
| 7,333,760 | B2 | 2/2008 | Baba et al. | |
| 2004/0037597 | A1 * | 2/2004 | Haseba et al. | 399/328 |
| 2005/0158075 | A1 | 7/2005 | Echigo et al. | |
| 2005/0271409 | A1 * | 12/2005 | Omata | 399/73 |
| 2006/0013624 | A1 | 1/2006 | Kurotaka et al. | |
| 2006/0019082 | A1 | 1/2006 | Kikuchi et al. | |
| 2006/0088349 | A1 | 4/2006 | Someya et al. | |
| 2006/0120776 | A1 | 6/2006 | Takashi et al. | |
| 2006/0140689 | A1 | 6/2006 | Echigo et al. | |
| 2006/0165443 | A1 | 7/2006 | Yoshinaga et al. | |
| 2006/0165448 | A1 | 7/2006 | Yoshinaga | |
| 2006/0257183 | A1 | 11/2006 | Ehara et al. | |
| 2006/0263122 | A1 | 11/2006 | Hachisuka | |
| 2007/0065188 | A1 | 3/2007 | Takagaki et al. | |
| 2007/0104520 | A1 | 5/2007 | Nakafuji et al. | |

FOREIGN PATENT DOCUMENTS

| | | |
|---|---|---|
| JP | 1-160469 | 11/1989 |
| JP | 2001-265158 | 9/2001 |
| JP | 2001-282034 | 10/2001 |
| JP | 2001-318548 | 11/2001 |
| JP | 3346168 | 9/2002 |
| JP | 2006-201370 | 8/2006 |
| JP | 2006-201640 | 8/2006 |
| JP | 2006-243465 | 9/2006 |

OTHER PUBLICATIONS

Per client, U.S. Appl. No. 11/898,130, filed Sep. 10, 2007.

* cited by examiner

FIG. 10

| TONER NO. | TONER BINDER CHARACTERISTICS | | |
|---|---|---|---|
| | PEAK MOLECULAR WEIGHT | ACID VALUE | Tg |
| 1 | 4000 | 10 | 55 |
| 2 | 5200 | 8 | 60 |
| 3 | 4500 | 15 | 62 |
| 4 | 6000 | 4 | 52 |
| 11 | 8000 | 7 | 57 |
| 12 | 7000 | 7 | 58 |

FIG. 11

| EXAMPLE NO. | Dv | Dn | Dv/Dn | ROUNDNESS | FLUIDITY | FIXING LOWER LIMIT TEMPERATURE (°C) | HOT OFFSET TEMPERA-TURE (°C) | GLOSS TEMPERA-TURE (°C) | HAZE | COLORANT PARTICLE SIZE (μm) | COLORANT PARTICLES OVER 0.7 μm (%) |
|---|---|---|---|---|---|---|---|---|---|---|---|
| 1 | 5.5 | 4.8 | 1.15 | 0.940 | 0.30 | 150 | 220 | 160 | AVERAGE | 0.40 | 3.6 |
| 2 | 6.8 | 6.2 | 1.10 | 0.950 | 0.35 | 150 | 220 | 150 | GOOD | 0.25 | 1.0 |
| 3 | 4.9 | 4.2 | 1.17 | 0.930 | 0.44 | 160 | 230 | 160 | GOOD | 0.15 | 2.0 |
| 4 | 6.9 | 6.2 | 1.11 | 0.955 | 0.40 | 140 | 220 | 160 | GOOD | 0.15 | 3.0 |
| 11 | 6.0 | 4.6 | 1.30 | 0.970 | 0.25 | 155 | 200 | 160 | AVERAGE | 0.70 | 35.0 |
| 12 | 7.5 | 6.1 | 1.22 | 0.925 | 0.23 | 160 | 180 | 150 | AVERAGE | 0.70 | 15.0 |

IMAGE FORMING APPARATUS WITH GLOSSY IMAGE PRINTING MODE

CROSS-REFERENCE TO RELATED APPLICATIONS

This patent specification claims priority from Japanese Patent Application No. 2007-103229, filed on Apr. 10, 2007 in the Japan Patent Office, the entire contents of which are hereby incorporated by reference herein.

BACKGROUND OF THE INVENTION

1. Field of the Invention

The present invention generally relates to an image forming apparatus including a fixer.

2. Description of the Background Art

In various areas, an image forming apparatus, such as a copier, a facsimile machine, a printer, etc., that employs an electronographic method or an electrostatic recording method has been used. Such an image forming apparatus includes an image carrier on which an electrostatic latent image is formed, a developing device to develop the electrostatic latent image with a developer, a transferer to transfer the image onto a sheet of recording medium, and a fixer to fix the image on the sheet.

As an example, the fixer includes a pair of rollers facing each other, and one of these rollers is used as a heating roller and the other is used as a pressing roller to press the recording medium against the heating roller. In such a configuration, the unfixed toner image is fixed on the recording medium with heat from the heating roller and pressure from the pressing roller while the recording medium passes through a nip formed between these rollers.

Recently, a proportion of color images to total images output from such image forming apparatuses has been increasing, and with it increasing demand for higher quality images. One measure used to evaluate color image quality is gloss level of a toner portion. While images of lower gloss levels, for example, 15% or less, are generally preferred as business documents, images of higher gloss level, for example, 20% or greater, are generally preferred as printed materials including catalogues and brochures. Therefore, in some cases, it is necessary to use different types of image forming apparatuses depending on the purpose of use of output images.

Generally, to produce images of higher gloss levels, a fixing temperature and a fixing pressure are increased. However, in such a case, moisture in the recording medium is likely to vaporize and swell, causing spots in a toner image, which is a failure called blistering.

To prevent such blistering, fixers that perform preheating have been proposed. For example, in one known method, a fixer preliminarily heats the recording medium to 60 degrees Centigrade or higher when a coated paper discriminating means determines that the recording medium is a coated paper. In another known method, an upstream first fixer fixes a unfixed toner image on a first side of a recording medium and a downstream second fixer fixes a unfixed toner image on a second side of the recording medium. A heating temperature of the first fixer is lower than that of the second fixer, and the unfixed toner images on both sides of the recording medium are fixed in one fixing process. Further, in another known method, a plurality of fixing nips is formed with respect to a fixing belt, so that fluctuation in a belt transportation speed is prevented to achieve a uniform gloss level.

It is common to produce the toner for an electronograph through a kneading and pulverization method in which a thermoplastic resin is dissolved and kneaded together with a colorant and, if required, a releasing agent such as wax and/or a charge controller. This mixture is then pulverized and sorted. To surfaces of the toner particles thus obtained, inorganic or organic fine particles are added, as required, to improve fluidity and/or facilitate cleaning.

A toner produced through a known kneading and pulverization method generally has an indefinite form, a relatively broad particle distribution, relatively low fluidity, and relatively low transfer properties. The toner requires a relatively large amount of energy to be fixed, and a charge amount is rather uneven among the toner particles, and thus its charge stability is relatively low. Further, the quality of the images produced with such toner is inadequate.

As another method to produce toner, polymerization methods have been proposed. The polymerization methods do not include kneading and pulverization processes, and thus energy, production time, and cost can be reduced. Further, such a polymerized toner produced through polymerization has a particle distribution narrower than that of the toner produced through the pulverization method. Moreover, the fluidity of the polymerized toner can be enhanced significantly because capsulation of wax is relatively easy, and thus roundish toner particles can be produced relatively easily.

However, properties of such a polymerized toner are inadequate even though the polymerized toner particles are generally rounder than the pulverized toner particles because surface tension acts in the polymerization process. Further, controlling the ultimate shape of toner particles (deformation) is difficult in the polymerization method. As for the charge stability and the transfer properties, the polymerization methods are advantageous.

Among the polymerization methods, although a suspension polymerization method is widely used, in this method, a monomer for a binder (binder resin) is limited to styrene monomer, acrylic monomer, etc., which are harmful to humans. As a result, the toner produced through the suspension polymerization method includes such toxic components and is thus not environmentally friendly.

Further, because wax is included inside the toner particles in the case of the suspension polymerized method, the wax is less likely to appear on the surfaces of the toner particles when the toner is used, compared with the pulverized toner in which wax exist on the surfaces of the particles. Therefore, although the toner is less likely to adhere to the photoreceptor, the suspension polymerized toner has a lower fixing efficiency, thus consuming a greater amount of power for fixing than the pulverized toner does.

Further, in the case of the polymerized toner, when wax is increased in amount and/or dispersion particle diameter so as to enhance fixing, transparency of color image is impaired, and thus such a toner is not suitable for OHP films used in presentations.

Another method to produce a polymerized toner is an emulsion polymerization method that can deform particles to a certain level. In the emulsion polymerization method, the monomer to be used is also limited to styrene monomer, and removing an unreacted monomer, an emulsifier, and a dispersant from toner particles completely is difficult, and thus the toner is not environmentally friendly.

Yet another method to produce a polymerized toner is a dissolution suspension method that can use a polyester resin that is fixable at a lower temperature. However, because a component having a relatively large molecular weight is used in a process to dissolve or disperse such a resin and a colorant, viscosity of the dissolution or dispersion liquid is increased, and productivity is decreased.

Further, in the dissolution suspension method, toner particles are spherical and surfaces thereof are uneven so that the toner particles can be better cleaned. However, the shape of such toner particles is irregular, and charge stability thereof is relatively low. Moreover, durability and a release are relatively poor, and thus the quality thereof is inadequate.

A dry toner that has a practical sphericity within a range of from 0.90 to 1.00 has been proposed to improve fluidity, fixing at a low temperature (low temperature fixing properties), and resistance to hot offset. Hot offset is a phenomenon that occurs when toner is overheated, reducing cohesion among toner particles below that to a fixing roller or to paper. In such a condition, a toner layer separates, and toner in a resultant image will be partly absent.

Such a proposed toner uses a toner binder manufactured through an extending reaction of a urethane-modified polyester. Further, another dry toner has been proposed that has higher powder fluidity and transfer properties when the toner has a smaller particle diameter. This toner also excels in thermal and storage stability, the low temperature fixing properties, and resistance to hot offset. Methods to manufacture these toners include a molecular weight increasing process in which a polyester prepolymer containing an isocyanate group and amine perform polyaddition reaction in an aqueous medium.

However, in the polymerized toner obtained through the method described above, the colorant disperses unevenly, and transparency and saturation of images produced with such a toner is lower. The images are rather dark, particularly when images are formed on OHP films using such a toner,

SUMMARY OF THE INVENTION

In view of the foregoing, in one illustrative embodiment of the present invention, an image forming apparatus include an image forming part configured to form a toner image on a recording medium, a fixer including a heating member and a pressure member, configured to transport the recording medium sandwiched therein, while fixing the toner image on the recording medium with heat and pressure, a reverse transport part configured to reverse and forward the recording medium transported from the fixer to the image forming part, a toner image sensor configured to detect presence of the toner image on the recording medium, and a controller configured to control the image forming part, the fixer, and the reverse transport part. When a glossy image formation mode is selected and no toner image is detected on the recording medium, the image forming part does not form a toner image, the fixer performs a first heating and pressing process and transports the recording medium to the reverse transport part, and the reverse transport part transports the recording medium to the image forming part, the image forming part forms a toner image on the recording medium transported from the reverse transport part, and the fixer performs a second heating and pressing process and fixes the toner image on the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 10 is a table illustrating properties of example toner binders to be used in the image forming apparatus according to the illustrative embodiment; and FIG. 11 is a table illustrating properties of example toners to be used in the image forming apparatus according to the illustrative embodiment.

DETAILED DESCRIPTION OF PREFERRED EMBODIMENTS

Figure 1:
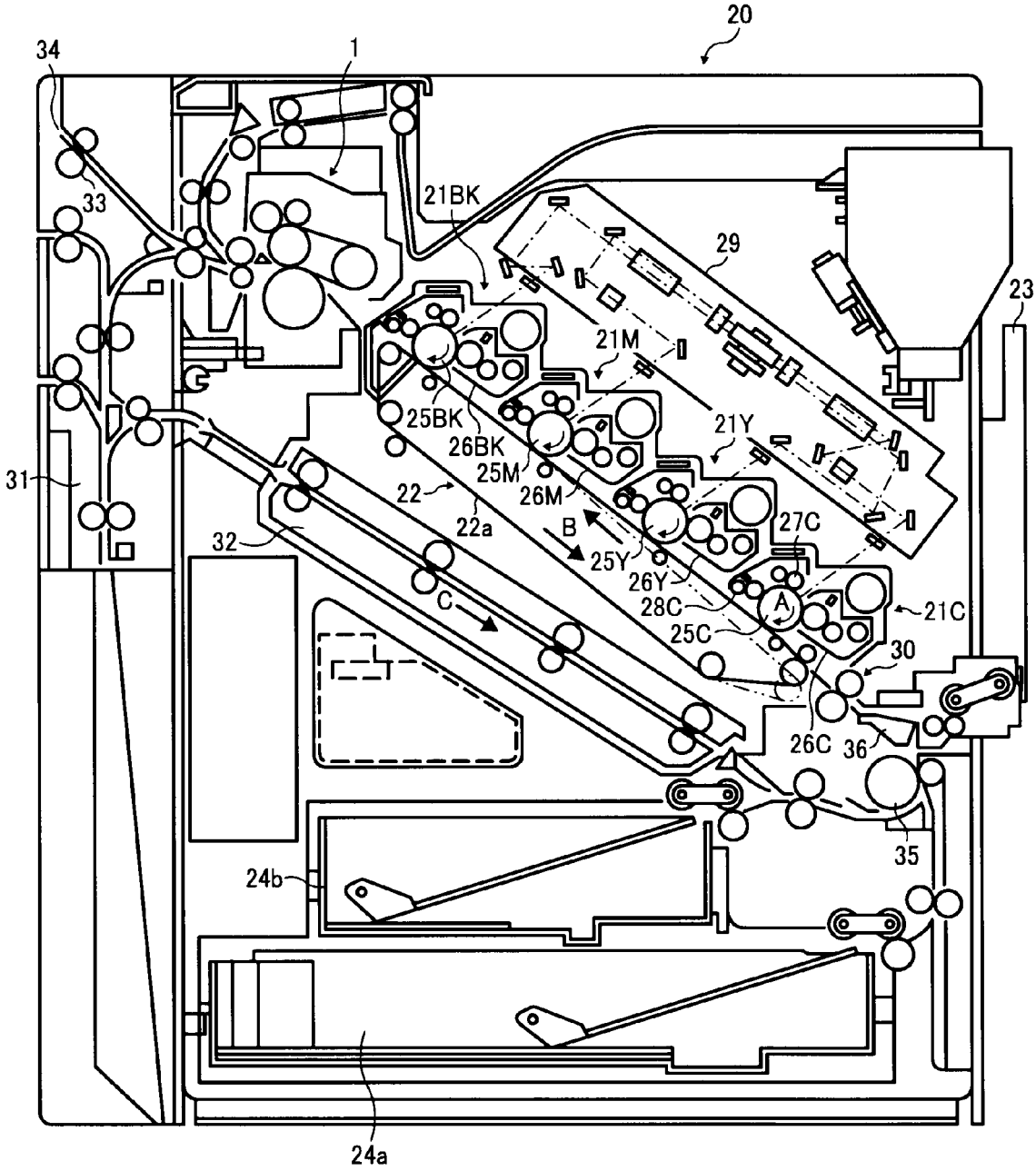
FIG. 1 is a diagram illustrating a schematic configuration of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus 20 according to an illustrative embodiment of the present invention is described. As the image forming apparatus 20, a copier or printer that can form full color images is used. Alternatively, the image forming apparatus 20 may be a facsimile machine that can perform image forming processes similar to those performed by the copier or printer according to image signals externally received. It is to be noted examples of the image forming apparatus 20 include a monochrome image forming apparatus.

Referring to FIG. 1, the image forming apparatus 20 includes an image forming part that includes image forming units 21C, 21Y, 21M, and 21BK that form respective color images corresponding to original images, and a transfer unit 22 facing the image forming units 21C, 21Y, 21M, and 21BK. An area in which the image forming units 21C, 21Y, 21M, and 21BK face the transfer unit 22 is hereinafter referred to as a transfer area. The image forming part forms a full color or monochrome image on a sheet P of recording medium, such as transfer paper. Above the image forming part, an optical writing device 29 is provided. The transfer unit 22 includes a transport belt 22*a* that rotates in a direction shown by arrow B.

As the sheet P, the image forming apparatus 20 can use a sheet that are commonly used in copying (standard sheet), an OHP (overhead projector) film, a sheet having a ream weight of 90 kg such as a post card, a thicker paper having a basic weight of 100 g/m$^2$ or greater, and a special sheet, such as an envelope, whose heat capacity is greater than that of the standard sheet.

The image forming apparatus 20 further includes a manual feed tray 23, sheet cassettes 24*a* and 24*b*, a pair of registration rollers 30, and a fixer 1. The sheet P is fed from one of the manual feed tray 23 and the sheet cassettes 24*a* and 24*b* that are recording medium feed members, and forwarded by the pair of registration rollers 30 to the transfer area in timely manner to match image forming timings of the image forming units 21C, 21Y, 21M, and 21BK. After the images are transferred from the image forming units 21C, 21Y, 21M, and 21BK and superimposed one on another on the sheet P, the fixer 1 fixes the superimposed image on the sheet P.

The image forming apparatus 20 according to the present embodiment can form images on both a first side and a second side of the sheet P in a double-side printing mode and further includes a sheet reverse unit 31 and a sheet transport unit 32 to transport the sheet P in a direction shown by arrow C. When the double-side printing mode is selected, after the fixer 1 fixes an image on the first side of the sheet P, the sheet P is reversed while transported through the sheet reverse unit 31 and the sheet transport unit 32. The sheet P is further transported to the pair of registration rollers 30 and then an image is formed on the second side thereof.

The reference letters C, Y, M, and BK indicate cyan, yellow, magenta, and black, respectively, and the image forming units 21C, 21Y, 21M, and 21BK are for forming cyan, yellow, magenta, and black images, respectively.

The image forming unit 21C includes a photoreceptor drum 25C as an electrostatic latent image carrier that rotates in a rotation direction shown by arrow A. Around the photoreceptor drum 25C, a charging device 27C, a developing device 26C, and a cleaner 28C are provided along the rotation direction shown by arrow A. The image forming unit 21C adopts a known configuration in which, between the charging device 27C and the developing device 26C, the photoreceptor drum 25C receives an exposure light corresponding to a cyan image from the optical writing device 29. Thus, an electrostatic latent image is formed on the photoreceptor drum 25C, and the electrostatic latent image is developed with a developer into a cyan toner image.

As the developer, there are one-component developer and two-component developer. The one-component developer include magnetic or nonmagnetic toner, and the two-component developer include toner and carrier.

It is to be noted that shape of the electrostatic latent image carrier is not limited to a drum, and alternatively, a belt-shaped electrostatic latent image carrier can be used. In the example shown in FIG. 1, a footprint of the image forming apparatus 20 can be smaller because the transfer unit 22 extends obliquely.

Similarly to the image forming unit 21C, each of the image forming units 21Y, 21M, and 21BK includes one of photoreceptor drums 25Y, 25M, and 25BK, one of developing devices 26Y, 26M, and 26BK, one of charging device 27Y, 27M, and 27BK, and one of cleaners 28Y, 28M, and 28BK. The image forming units 21C, 21Y, 21M, and 21BK have a similar configuration except for only the color of the toner used therein, and thus descriptions of the components thereof omitted.

The image forming apparatus 20 further includes a pair of discharge rollers 33, a disparage port 34, a transport roller 35, and a toner image detector 36 to determine presence of a toner image.

Figure 2:
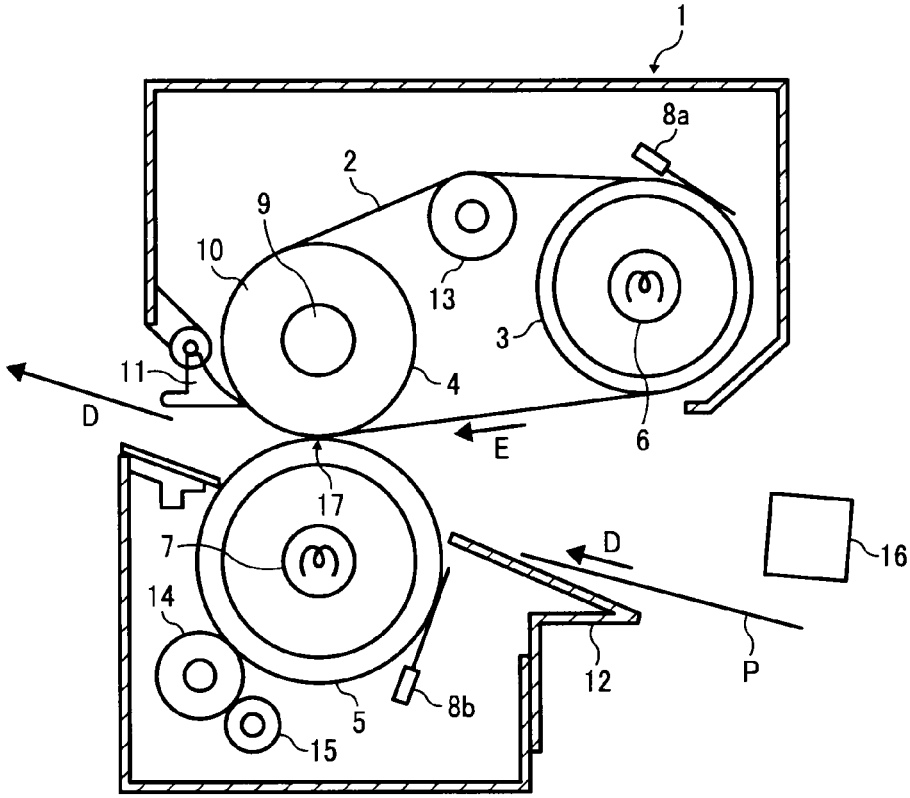
FIG. 2 is a schematic cross section diagram illustrating a fixer used in the image forming apparatus according to the illustrative embodiment.

FIG. 2 illustrates an example of the fixer 1 that is a belt type. As illustrated in FIG. 2, the fixer 1 includes an endless fixing belt 2 that serves as a heating member and is looped around a heating roller 3 and a fixing roller 4, a pressure roller 5 that serves as a pressure member and faces the fixing roller 4 via the fixing belt 2, heaters 6 and 7, a first temperature sensor 8*a*, and a second temperature sensor 8*b*. The heaters 6 and 7 are located inside the heating roller 3 and the pressure roller 5, respectively. The fixing belt 2 moves in a direction shown by arrow E and transports the sheet P in a direction shown by arrow D (sheet transport direction). The first and second temperature sensors 8*a* and 8*b* are thermistors, for example, and are located to face the fixing belt 2 and the pressure roller 5 to detect temperatures thereof, respectively.

Biased by an elastic member, not shown, a tension roller 13 presses the fixing belt 2 outward from to give the fixing belt 2 a predetermined or desired tension.

The fixing roller 4 includes a metal core 9 and an elastic layer 10 that is a heat-resistant porous layer covering the metal core 9. The fixing roller 4 is biased by an elastic member, not shown, in a direction to press against the pressure roller 5. Reference numeral 12 indicates a guide to guide the sheet P to a fixing nip 17 where the fixing roller 4 presses against the pressure roller 5 via the fixing belt 2.

It is to be noted that the heater 6 located inside the heating roller 3 has a heating capacity larger than that of the heater 7 located inside the pressure roller 5 because the fixing belt 2 has a heat capacity smaller than that of the pressure roller 5 and a start-up time in a cold start can be reduced when the pressure roller 5 receives heat from an outer surface of the fixing belt 2 in addition to the heater 7. In the present embodiment, the heating capacity of the heater 6 is 100 W and the heating capacity of the heater 7 is 200 W when a voltage of 100 V is applied thereto.

The heating roller 3, which drives the fixing belt 2 in cooperation with the fixing roller 4 facing the pressure roller 5, is provided with a heat source that heats an inner (back) surface of the fixing belt 2. Further, a heat source to heat the outer surface of the fixing belt 2 is provided inside the pressure roller 5. Because the fixing belt 2 has a cubic volume and a heat capacity each smaller than those of a roller, temperature thereof can be raised in a shorter time period, and thus the fixer 1 has an advantage in that temperature can be raised in a shorter time period compared with a configuration that uses only the heating roller 3 and the pressure roller 5. Moreover, by including the heating source in the pressure roller 5, both the outer and inner surfaces of the fixing belt 2 can be heated so as to heat the fixing belt 2 more quickly.

The fixer 1 further includes a separation claw 11, an oil application roller 14, a cleaning roller 15, and a humidity sensor 16. The separation claw 11 is provided downstream of a fixing nip in the sheet transport direction shown by arrow D, with a tip thereof pressed against the outer surface of the fixing belt 2. When the sheet P adheres to the outer surface of the fixing belt 2, the separation claw 11 separates the sheet P from the fixing belt 2 by entering therebetween while the sheet P is transported to prevent the sheet P from being wound around the fixing belt 2.

The fixer 1 adopts a configuration in which silicone oil is applied to the fixing belt 2 to enhance a toner releasing property thereof. The oil application roller 14 is used to apply a small amount of silicone oil to the fixing belt 2. The oil application roller 14 includes a metal core, a sponge-like foam member impregnated with silicone oil provided over the metal core, and a semipermeable membrane rapped over the foam member singly or doubly. Because the semipermeable membrane has microscopic pores, silicone oil included in the foam member seeps out therethrough, and thus the oil application roller 14 applies only a relatively small amount of oil to an object facing the application roller 14. As the surface membrane of the oil application roller 14, a material having a better toner releasing property is used so as to prevent toner from firmly sticking on the surface of the oil application roller 14 when toner adheres thereto, for example, during a paper jam. If toner firmly sticks on the oil application roller 14 and fills in the microscopic pores through which the oil soak out, oil application is inhibited. In the present embodiment, a Gore-Tex (trademark) membrane is used for the surface membrane as a material having a higher releasing property.

The cleaning roller 15 removes any toner adhering to the oil application roller 14, and the humidity sensor 16 detects humidity inside the image forming apparatus 20 shown in FIG. 1.

The sheet P having the toner image on the first side thereof is transported to the fixer 1 in the direction shown by arrow D, and the guide 12 guides the sheet P to the fixing nip 17. At the fixing nip 17, the sheet P is sandwiched and pressed between the fixing roller 4 and the pressure roller 5 and further heated by the fixing belt 2 so as to fix the toner image thereon. The sheet P is then further transported in the direction shown by arrow D by the fixing roller 4 that rotates to drive the fixing belt 2 in the direction shown by arrow E.

In the present embodiment, a single-side printing mode M1 to form a toner image on only one side of the sheet P and a double-side printing mode M2 are selectable in the image forming apparatus 20. Further, two modes are selectable regarding the sheet P itself: A glossy image mode M3 using the sheet P, which is a coated sheet in which a coating layer including a resin covers a base and form a glossy toner image on the coating layer; and a standard mode M4, to form a toner image on a standard sheet.

Described below, in order are: A standard single-side printing mode (M4+M1 mode), a standard double-side printing mode (M4+M2 mode), a glossy image single-side printing mode (M3+M1 mode), and a glossy image double-side printing mode (M3+M2 mode) using the image forming apparatus 20.

Referring to FIGS. 1 and 2, in the standard single-side printing mode, the optical writing device 29 directs exposure lights corresponding to respective colors onto the photoreceptor drums 25C, 25Y, 25M, and 25BK to form electrostatic latent images thereon. These electrostatic latent images are developed into respective color images by the developing devices 26C, 26Y, 26M, and 26BK, respectively. From one of the manual feed tray 23 and the sheet cassettes 24*a* and 24*b*, a sheet P that is a standard sheet is fed. The registration rollers 30 forward the sheet P to the transport belt 22*a* in such a timely manner that the toner images are transferred from the photoreceptor drums 25C, 25Y, 25M, and 25BK and superimposed one on another on a first side of the sheet P while the transport belt 22*a* transports the sheet P in the direction shown by arrow B. After the toner image is thus formed thereon, the sheet P is transported to the fixer 1 where the toner image is fixed with heat and pressure by the fixing roller 4 and the pressure roller 5, and discharged by the discharge rollers 33 through the disparage port 34.

In the standard double-side printing mode, processes are similar to the processes performed in the standard single-side printing mode. However, after the fixer 1 fixes the toner image formed on the first side of the sheet P, the sheet P is not discharged through the discharge port 34, but a switch claw, not shown, changes a transport route of the sheet P toward the sheet reverse unit 31.

After being reversed by the reverse unit 31 so that the first side, on which the toner image is formed, faces up, the sheet P is transported to the sheet transport unit 32, where the sheet P is further transported in the direction shown by arrow C toward the registration rollers 30. The registration rollers 30 forward the sheet P to the transfer unit 22 with a second side thereof facing up and the first side thereof facing down in such timely manner that a toner image is formed on the second side of the sheet P. After the fixer 1 fixes the toner image on the second side of sheet P, the sheet P is discharged through the discharge port 34.

The glossy image single-side printing mode is described below.

Because an amount of heat required to fix a glossy toner image on a coated sheet is greater than that required to fix a toner image on the standard sheet, in a method to fix the toner image with a fixer, preheating is commonly performed before the sheet is transported to the fixer.

For example, a fixer can include a first heating roller and a first pressure roller for preheating, provided upstream of a second fixing roller and a second pressure roller for fixing the toner image, and the sheet is heated preliminarily while passing through between the first heating roller and the first pressure roller. However, such a fixer is larger and costs more because two pairs of heating rollers and pressure rollers each are included therein instead of one.

Therefore, in the present embodiment, double-side printing process is used to preheat the sheet P so as to produce excellent glossy toner images without an additional preheating device.

In the present embodiment, when the user selects the glossy image mode M3, the image forming apparatus 20 is set to the glossy image mode M3. For example, the sheet cassette 24*b* contains the coated sheets each including a coated layer, and the coated sheet is fed as the sheet P with the coated side (first side) down from the sheet cassette 24*b* to the registration rollers 30. While the sheet P is thus transported, the toner image detector 36 shown in FIG. 1, provided between the transport roller 35 and the registration rollers 30, detects that no toner images are formed on the first side of the sheet P.

When the glossy image mode M3 is set and the toner image detector 36 detects no toner images on the first side of the sheet P as described above, the image forming units 21C, 21Y, 21M, and 21BK do not perform the image forming processes and instead the sheet P is transported to the fixer 1 by the registration rollers 30 and the transport belt 22*a*. In the fixer 1, a first heating and pressing process of the sheet P is performed by the fixing roller 4 and the pressure roller 5 as a preheating process, and then the switch claw, not shown, forwards the sheet P to the reverse unit 31.

The sheet P is reversed by the transport roller 35 so that the coated side (first side) thereof turns up and then transported to the registration rollers 30. The registration rollers 30 adjust the timing to forward the sheet P to the image forming units 21C, 21Y, 21M, and 21BK. When image forming conditions of the image forming units 21C, 21Y, 21M, and 21BK are right, the sheet P is transported along the image forming units 21C, 21Y, 21M, and 21BK so that respective color toner images are transferred onto the coated side thereof and then forwarded to the fixer 1. The fixer 1 then performs a second heating and pressing process of the sheet P to fix the toner image on the coated side thereof, and then the sheet P is discharged through the discharge port 34.

In this case, as described above, the sheet P is preheated in the first heating and pressing process before the toner image is fixed thereon in the second heating and pressing process, and thus an excellent glossy toner image can be produced, as is shown by an analysis of the relation between heating control temperature of the fixer 1 and a gloss level of the toner image that is now described below.

Figure 3:
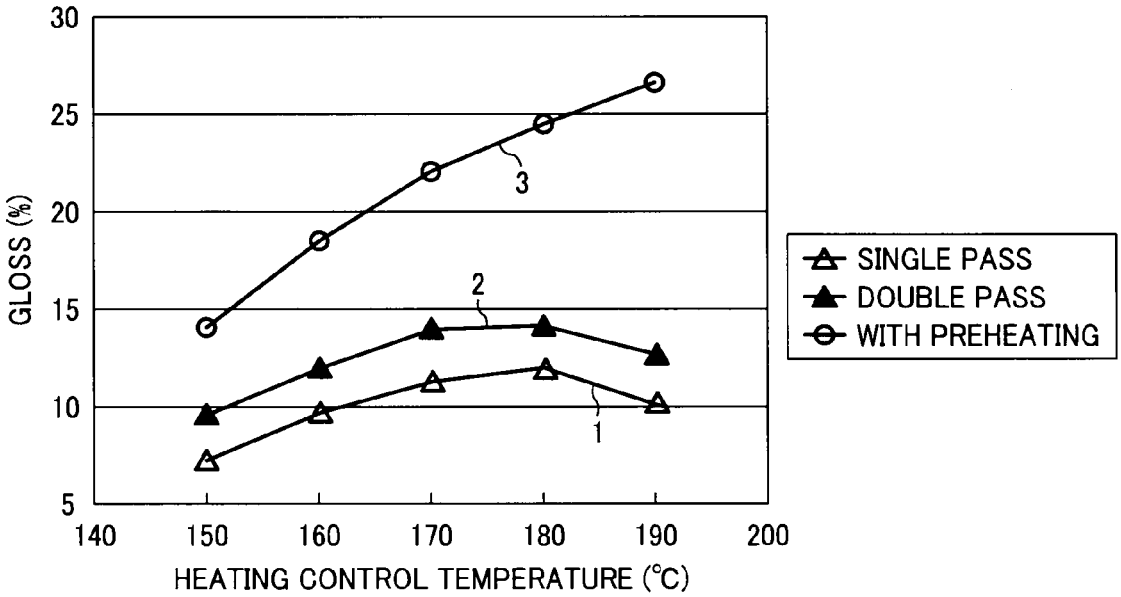
FIG. 3 is a graph illustrates relations among gloss level of images, heating control temperature, and preheating.

FIG. 3 is a graph illustrating a relation between a heating control temperature of the fixer 1 and a gloss level of the toner image. The graph shown in FIG. 3 is created based on experiments in which a toner adhesion amount was set to 0.8 $mg/cm^2$, an image forming linear speed was set to 180 mm/s, and a sheet having a basic weight of 75 $g/m^2$ was used as the sheet P.

In FIG. 3, a line 1 is results of a first experiment in which a toner image was formed and fixed only on the first side of the sheet P without preheating as in the standard single-side printing mode, which is hereinafter also referred to as single pass.

A line 2 is results of a second experiment in which, after a toner image was formed and fixed on the first side of the sheet P without preheating, the sheet P was reversed through a sheet reverse path and then the fixing process was performed on the second side thereof without forming a toner image thereon, which is hereinafter also referred to as double pass.

A line 3 is results of a third experiment according to the present embodiment in which, after the first heating and pressing process (preheating) was performed on the first side of the sheet P without forming a toner image thereon, the sheet P was reversed through the sheet reverse path, and a toner image was formed and fixed on the second side in the second heating and pressing process (fixing process). The third experiment is hereinafter also referred to as with preheating.

Referring to FIG. 3, in the first experiment whose results are shown by the line 1, the gloss of the toner image was about 10%, and when the fixing control temperature was about 190° C., a hot offset phenomenon occurred on a surface of the toner image and the gloss level was reduced.

In the second experiment whose results are shown by the line 2, although the gloss was higher by about 2% than that in the experiment 1, when the fixing control temperature was about 190° C., a hot offset phenomenon occurred on a surface of the toner image and the gloss level was reduced similarly to the first experiment.

In the third experiment according to the present embodiment whose results are shown by the line 3, the gloss was enhanced to about 25%, and a hot offset phenomenon did not occur and the higher gloss level was maintained even when the fixing control temperature was as high as about 190° C.

The results of the third experiment are attributed to the fact that the sheet P is warmed when passing through the fixing nip 17 in the first heating and pressing process (preheating process) performed on the first side thereof without forming a toner image. More specifically, when the toner image is formed and fixed on the first side after the sheet P is thus warmed, the toner image is warmed not only by the fixing roller 4, but also by the sheet P, and thus the toner is melted more uniformly and the surface of the toner image becomes smoother than in the first experiment.

Further, it is possible that hot offset did not occur even when the fixing control temperature was as high as about 190° C. because, in the first experiment, a surface layer of the toner image is easily removable because the toner differently melts in a portion close to the fixing roller 4 and another portion close to the sheet P. By contrast, when the preheating process is performed as in the experiment 3, the toner becomes uniform throughout a toner layer immediately after passing through the fixing nip 17, and thus the surface layer of the toner is not easily removable.

In an image forming apparatus that has a function to perform double-side processes automatically, the sheet P can be preheated by passing through the fixing nip 17 where the sheet P is heated and pressed without forming a toner image on a first side of the sheet P. By forming a toner image on a second side of the sheet subsequently to the preheating process, a toner image having an enhanced gloss can be produced with hot offset prevented or reduced by using such an image forming apparatus.

Described below is another embodiment in which the gloss of the toner image can be further enhanced when a heating temperature to heat the sheet P is higher in the first heating and pressing process (preheating process) than in the second heating and pressing process (fixing process).

Figure 4:
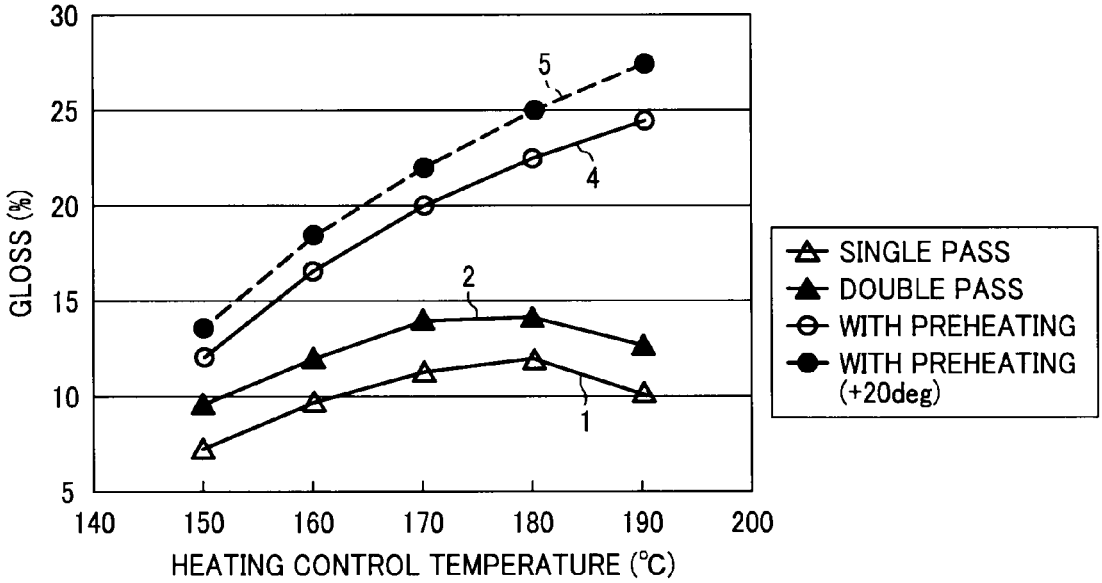
FIG. 4 is a graph illustrates relations between gloss level of images and heating control temperature when heating temperature in preheating is changed.

FIG. 4 is a graph illustrating a relation between a heating control temperature of the fixer 1 and a gloss level of the toner image both when the heating temperature is identical and different in the first heating and pressing process and the second heating and pressing process. The lines 1 and 2 show results of the single pass (first experiment) and the double pass (second experiment), respectively, similarly to those shown in FIG. 3. A line 4 shows results of an experiment 4 in which the preheating process was performed similarly to the experiments 3, and the heating temperature was identical in both the first heating and pressing process (preheating process) and the second heating and pressing process (fixing process). A line 5 shows results of an experiment 5 in which the heating temperature in the first heating and pressing process (preheating process) was higher by 20° C. than that in the second heating and pressing process (fixing process).

As is clear from the lines 4 and 5, the gloss of the toner image was higher by about 2% in the experiment 5, in which the heating temperature in the first heating and pressing process was higher by 20° C. than that in the second heating and pressing process, than in the experiment 4. Further, when the first side of the sheet P is thus preheated, hot offset does not occur because no toner images are formed on the first side of the sheet P, and thus a greater amount of heat can be given to the sheet P.

Described below is another embodiment in which the gloss level of the toner image can be enhanced by changing a fixing linear speed at which the sheet P passes through the fixing nip 17 shown in FIG. 2 in the first and second heating and pressing process, similarly to changing the heating temperature in the first and second heating and pressing process in the embodiment described with reference to FIG. 4.

Figure 5:
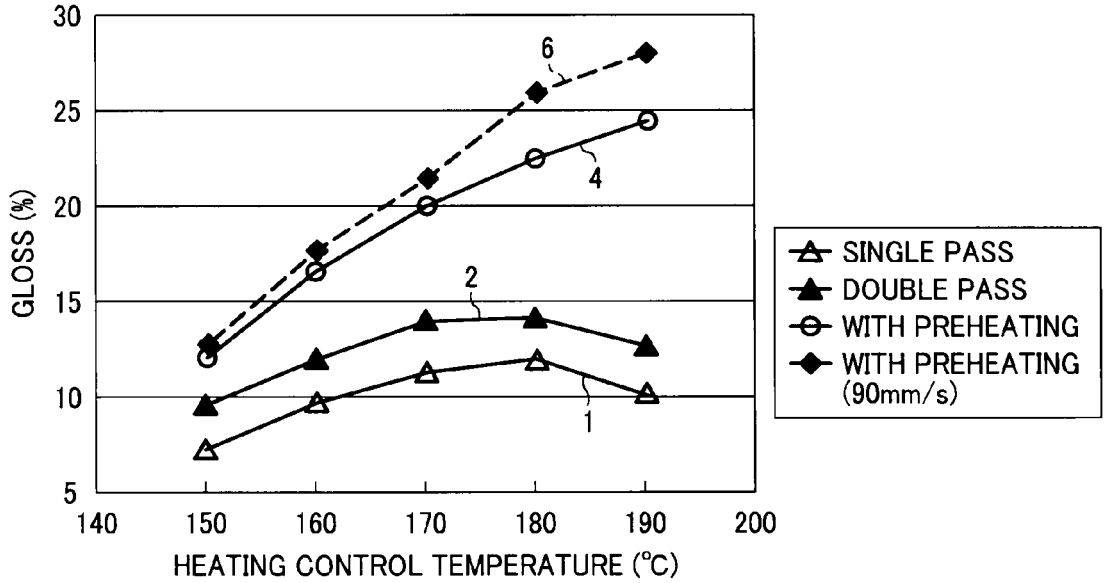
FIG. 5 is a graph illustrates relations between gloss level of images and heating control temperature when a linear speed in preheating is changed.

FIG. 5 is a graph illustrating a relation between a heating control temperature of the fixer 1 and a gloss level of the toner image when the fixing linear speed is identical and different in the first and second heating and pressing process. The line 4 shows the results of the experiment 4 in which the fixing linear speed is identical in both the first and second heating and pressing process, and a line 6 shows results of an experiment 6 in which the fixing linear speed in the first heating and pressing process was 90 mm/s and was slower by 50% than that in the second heating and pressing process. The graph shown in FIG. 5 also includes the lines 1 and 2 shown in FIG. 3 as references.

As is clear from the lines 4 and 6, the gloss of the toner image is enhanced by lowering the fixing linear speed in the first heating and pressing process from the fixing linear speed in the second heating and pressing process. It is to be noted that the linear speed to transport the sheet P is slowed only for a time period during which the sheet P passes through the fixing nip 17. It is preferable to transport the sheet P along the sheet reverse path at a predetermined or given linear speed so as to reduce a decrease in temperature of the sheet P after the sheet P passes through the fixing nip 17.

It is to be noted that a Konica Minolta GM-60 gloss meter, with a measurement angle of 60 degrees, was used in the experiments 1 through 6 shown in FIGS. 3 through 5.

In the first heating and pressing process in which a heating member and a pressure member give heat to the sheet P, the sheet P is likely to curl up if a surface temperature of the pressure member is lower than that of the heating member, particularly under humid conditions. If the sheet P curls, a transport error is likely to occur when the sheet P passes through the fixer 1, the sheet reverse unit 31, or the sheet transport unit 32. Such a transport error includes jamming, in which a leading edge of the sheet P gets stuck at an entry of each unit. To prevent curling of the sheet P, it is preferable to detect an absolute temperature inside the image forming apparatus and to control the surface temperatures of the heating member and the pressure member based on the absolute temperature thus detected.

Referring to FIG. 2, the inventors of the present invention have discovered that curling of the sheet P does not affect transport of the sheet P or does not occur when a certain relation is satisfied among the absolute humidity inside the image forming apparatus, and surface temperatures of the fixing belt 2 and the pressure roller 5. The relation may be expressed as:

$$Y-Z \leqq (-6.7 \times X)-150 \qquad \text{Expression 1}$$

wherein Y is the surface temperature of the fixing belt 2 (° C.), Z is the surface temperature of the pressure roller 5 in (° C.), and X is an absolute humidity (g/m$^3$) detected by the humidity sensor 16.

If the relation shown by the expression 1 is not satisfied, it is preferable to idle the fixer 1 so as to adjust the surface temperatures of the fixing belt 2 and the pressure roller 5 and suspend feeding of the sheet P until this relation is satisfied.

Alternatively, when the image forming apparatus includes a relative humidity detector element and a temperature detector element, the absolute humidity to be used in the expression 1 may be calculated by using the relative humidity detector element and the temperature detector element.

Further, a thinner sheet, particularly a sheet having a basic weight of 60 g/m$^2$ or less, is more likely to curl up than is a standard sheet having a basic weight of greater than 60 g/m$^2$. Therefore, when the sheet P is such a thinner sheet, an expression 2, shown below, that adjusts the expression 1 with a coefficient is effective.

$$Y-Z \leqq \{(-6.7 \times X)-150\} \times 0.9 \qquad \text{Expression 2}$$

It is to be noted that the control of the surface temperatures of the fixing belt 2 and the pressure roller 5 based on the expression 2 is also effective for a sheet having a basic weight within a range of from 60 to 80 g/m$^2$, depending on conditions under which the sheet is stored.

By using the expression 2, curling of the thinner sheets can be prevented or reduced, and thus transport error can be prevented.

It is to be noted that the image forming apparatus may include a detector to determine whether or not the sheet P is a thinner sheet. Alternatively, the image forming apparatus may adopt a method in which the relation used to control the surface temperatures of the fixing belt 2 and the pressure roller 5 is changed to the relation shown by the expression 2 by the user indicating, via an input from an operation panel, etc., that the sheet P is the thinner sheet described above.

Described below is the glossy image double-side printing mode (M3+M2 mode).

As described in the description of the glossy image single-side printing mode (M3+M1 mode), the user selects the glossy image mode M3 so as to set the image forming apparatus 20 shown in FIG. 1 to the glossy image mode M3, and further selects the double-side printing mode M2. In this case, a sheet having coated layers on both sides thereof is used as the sheet P and is contained, for example, in the sheet cassette 24*b*.

While the sheet P is transported, the toner image detector 36 shown in FIG. 1 detects that no toner images are formed thereon. When the glossy image mode M3 is set and the toner image detector 36 determines that no toner images are formed on the first side of the sheet P, the image forming units 21C, 21Y, 21M, and 21BK do not perform the image forming processes. The registration rollers 30 and the transport belt 22*a* transport the sheet P to the fixer 1 where the fixing roller 4 and the pressure roller 5 perform the first heating and pressing process (preheating process). Then, the sheet P is further transported to the sheet reverse unit 31 by the switch claw, not shown.

After passing the sheet reverse unit 31, the sheet P is reversed by the transport roller 35 and transported to the image forming units 21C, 21Y, 21M, and 21BK so that the respective color toner images thereon are transferred and superimposed one on another on the coated layer on the first side of the sheet P. Then, the sheet P is transported to the fixer 1 where the fixing roller 4 and the pressure roller 5 perform the second heating and pressing process (fixing process) to fix the toner image formed on the coated layer. The sheet P is again reversed while transported through the sheet reverse unit 31, the sheet transport unit 32, and the transport roller 35, and transported to the image forming units 21C, 21Y, 21M, and 21BK with the second side thereof up. While the sheet P is transported along the image forming units 21C, 21Y, 21M, and 21BK, a toner image is formed on the second side of the sheet P, and then the fixer 1 performs a third heating and pressing process to fix the toner image. After the toner image is fixed, the sheet P is discharged from the discharge port 34.

In the glossy image double-side printing mode, because the toner image is fixed in the second heating and pressing process after the sheet P is preheated in the first heating and pressing process, an excellent glossy toner image can be formed.

Referring to the block diagram shown in FIG. 6, described below is a control mechanism included in the image forming apparatus 20 that has the functions described above.

Figure 6:
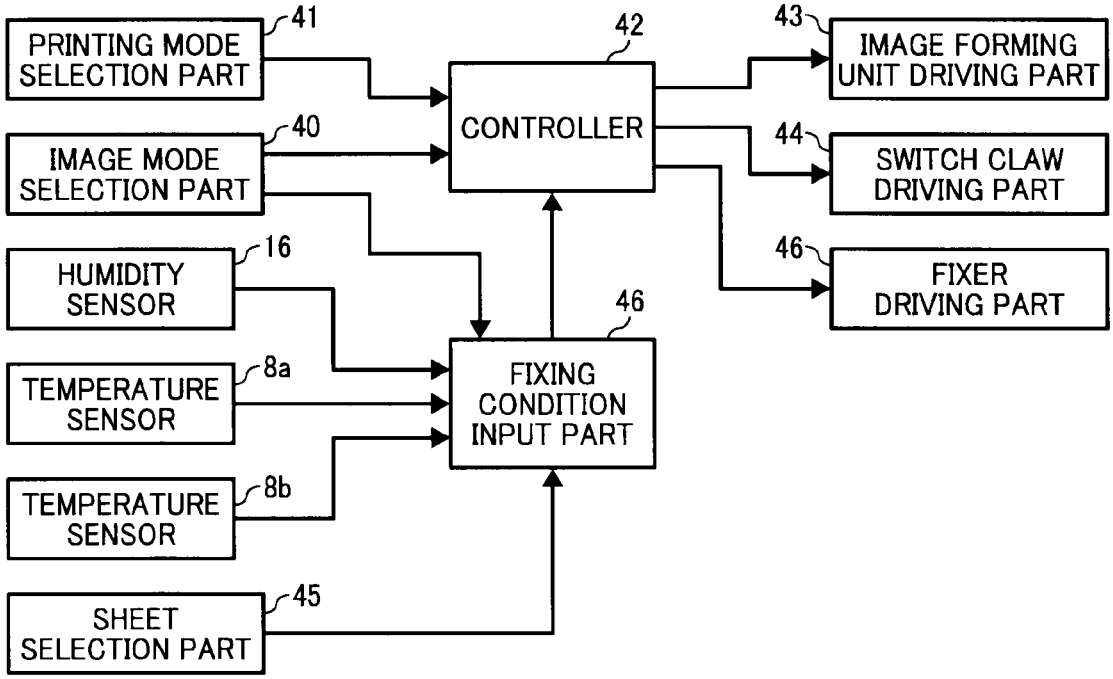
FIG. 6 is a block diagram of a controller used in the image forming apparatus according to an illustrative embodiment of the present invention.

As shown in FIG. 6, the image forming apparatus 20 includes an image mode selection member 40, a printing mode selection member 41, a controller 42, an image forming unit driving member 43, and a switch claw driving member 44. The image mode selection member 40 selects one of the glossy image mode M3 and the standard mode M4, and the printing mode selection member 41 selects one of the single-side printing mode M1 and the double-side printing mode M2.

According to the selection made by the image mode selection part 40 and the printing mode selection part 41, the controller 42 controls the image forming unit driving part 43 so as to start and stop image formation on the sheet P, following the procedure of one of the four modes described above. Further, the controller 42 controls the switch claw driving part 44 so as to switch the sheet transport path to one of the sheet reverse unit 31 and the discharge port 34, according to the selection made by the image mode selection part 40 and the printing mode selection part 41.

The image mode selection part 40 and the printing mode selection part 41 allow the user to select the modes described above on a control panel, not shown, provided on the image forming apparatus 20.

The control mechanism further includes a sheet selection part 45, the first temperature sensor 8*a* to detect the heating temperature of the fixing belt 2, the second temperature sensor 8*b* to detect the heating temperature of the pressure roller 5, a fixing condition input part 46, and a fixer driving part 47.

The sheet selection part 45 determines whether or not the basic weight of the sheet P is greater than 60 g/m$^2$. The fixing condition input part 46 determines which of the relations expressed by the expressions 1 and 2, described above, should be applied based on input from the sheet selection part 45, the humidity sensor 16, and the first temperature sensor 8*a* and the second temperature sensor 8*b*, and sets the fixing conditions. The controller 42 controls the fixer driving part 47 based on input from the fixing condition input part 46.

Further, when the image mode selection part 40 selects the glossy image mode and inputs that selection to the controller 42, the controller 42 sets the heating temperature and the fixing linear speed in the first heating and pressing process (preheating process) and controls the fixer driving part 47 so that the fixer 1 operates according to the sent fixing conditions.

It is to be noted that the fixer is not limited to the belt type fixer 1 shown in FIG. 2, and alternatively, other types of fixers may be used.

Figure 7:
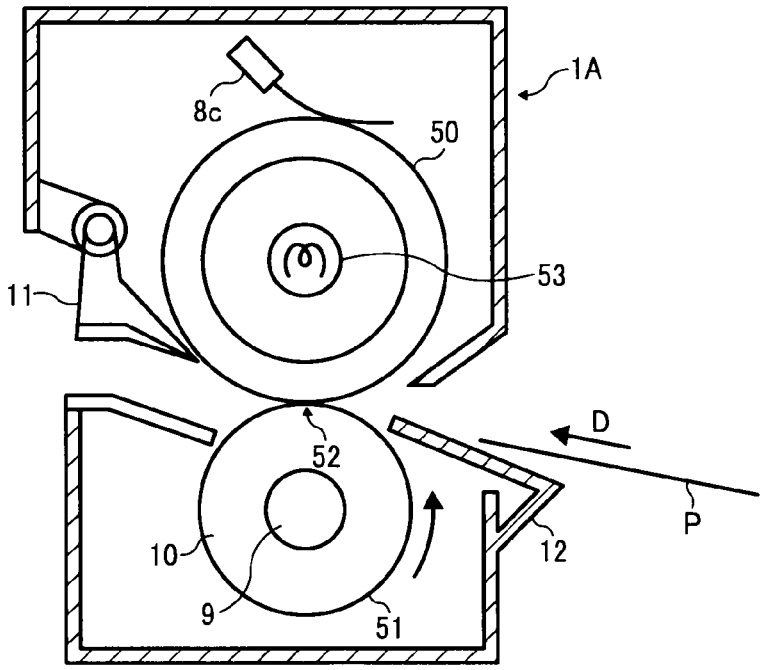
FIG. 7 is a schematic cross section diagram illustrating another fixer according to the illustrative embodiment of the present invention.

FIG. 7 shows an example of a roller type fixer 1A according to another embodiment of the present invention. As shown in FIG. 7, the fixer 1A includes a heating roller 50, a pressure roller 51, a thermistor 8*c*, a separation claw 11, and a guide 12 that guides the sheet P. The thermistor 8*c* is provided to face the heating roller 50 and serves as a temperature detector to detect a surface temperature of the heating roller 50.

The fixer 1A fuses and fixes the toner image on the sheet P with heat from the heating roller 50, while the sheet P is held in a fixing nip 52 formed between the heating roller 50 and the pressure roller 51 and transported in the sheet transport direction shown by arrow D.

The heating roller 50 includes a metal core including aluminum and is covered with a nonconductive PFA (tetrafluoroethylene-perfluoroalkylvinylether copolymer) layer having a thickness of about 20μ so as to secure releasability from the toner. A heater 53 is provided inside the heating roller 50, and a heating capacity thereof is 1200 W when a voltage of 100 V is applied.

The pressure roller 51 includes a metal core 9 and an elastic layer 10 that covers the metal core 9, and a conductive PFA tube that covers the elastic layer 10 and has a thickness within a range of from 30μ to 50μ. The elastic layer 10 is a heat-resistant, porous material, such as silicone foam rubber. The pressure roller 51 is urged by an elastic member, such as a spring, in a direction to press against the heating roller 50.

The separation claw 11 is located downstream of the fixing nip 52 in the sheet transport direction shown by arrow D, with a tip thereof pressed against the outer surface of the heating roller 50. When the sheet P adheres to the outer surface of the heating roller 50, the separation claw 11 separates the sheet P from the heating roller 50 by entering therebetween while the sheet P is transported to prevented the sheet P from winding around the heating roller 50.

An advantage of the roller type fixer described above is that it is more compact than a belt type fixer.

Figure 8:
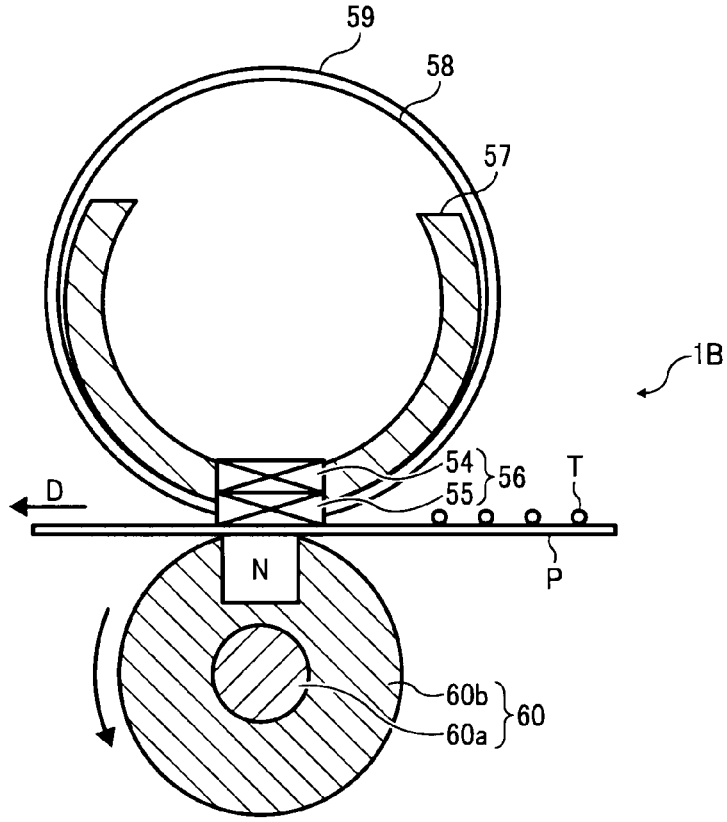
FIG. 8 is a schematic cross section diagram illustrating another fixer according to an illustrative embodiment of the present invention.

FIG. 8 shows an example of an electromagnetic induction fixer 1B using a free nip belt method, according to another embodiment of the present invention.

As shown in FIG. 8, the fixer 1B includes a fixing roller 59 and a pressure roller 60. The fixing roller 59 includes a heating member 56 including an excitation coil unit 54 and a magnetic metal member 55, a film interior guide 57 to which the heating member 56 is attached, and a cylindrical heat-resistant film 58. The film 58 covers the film interior guide 57 with the magnetic metal member 55 contacting an inner wall thereof. The pressure roller 60 contacts the film 58 where the magnetic metal member 55 is located so as to form a fixing nip portion N with the film 58, and rotates the film 58 as the free nip belt.

Examples of the film 58 include a heat-resistant single layer film of PTFE (polytetra fluoro ethylene), PFA, FEP (tetrafluoroethylene-hexafluoropropylene copolymer), etc., having a thickness of not greater than 100μ, more preferably, within a range from 20μ to 50μ. Alternatively, the film 58 may be a multilayer film including a film of polyimide, polyamide-imide, PEEK (polyether ether ketone), PES (polyether sulfone), PPS (polyphenylene sulfide), etc. whose outer surface is coated with PTFE, PFA, FEP, etc.

The film interior guide 57 is a rigid, heat-resistant member including resin such as PEEK, PPS, etc. The heating member 56 is attached to a substantially central portion of the film interior guide 57 in a longitudinal direction thereof.

The pressure roller 60 includes a core 60*a* and a heat-resistant rubber layer 60*b*, such as silicone rubber, that covers the core 60*a* and has better releasability. The pressure roller 60 is urged by a predetermined or given bearing and/or an urging member, not shown, so as to press against the magnetic metal member 55 of the heating member 56 via the film 58 with a predetermined or given pressure.

The pressure roller 60 is rotatively driven counterclockwise by a driving member, not shown, and this rotation generates a frictional force between the pressure roller 60 and the film 58. The rotation force acts on the film 58, and the film 58 rotates slidably while contacting the magnetic metal member 55 of the heating member 56. When the temperature of the heating member 56 reaches a predetermined or given temperature, the sheet P having unfixed toner images T formed by the image forming units 21C, 21Y, 21M, and 21BK shown in FIG. 1 is transported between the film 58 and the pressure roller 60 in the fixing nip portion N, in the sheet transport direction shown by arrow D. While the sheet P is sandwiched between the film 58 and the pressure roller 60 and transported through the fixing nip portion N, the magnetic metal member 55 heats the sheet P through the film 58, and thus the toner images T are fused and fixed thereon.

At an exit of the fixing nip portion N, the sheet P is separated from a surface of the film 58 and discharged onto a discharge tray, not shown.

Such a free nip belt fixer described above responds quickly when a control temperature is changed, and is suitable for the image forming apparatus according to the present invention.

In addition, because the electromagnetic induction fixer 1B described above uses eddy current, the magnetic metal member 55 that is a heating member can be located close to the toner images T on the sheet P via the film 58, with better heating efficiency than that of a fixer using a film heating method.

Further, a fixer used in a full color image forming apparatus requires a capacity to thoroughly fuse a thicker toner image having more than four toner particle layers. Therefore, to meet this requirement, an elastic rubber layer having a thickness of about 200 μm is formed on the film 58 in the fixer 1B so that the toner image is overlapped fully and fused uniformly.

The electromagnetic induction heater requires a shorter time period to change the control temperature compared with a fixer using a halogen heater, and thus it is suitable for the image forming apparatus according to the present invention.

Described below is a suitable toner for the embodiments of the present invention so as to produce excellent glossy images.

Figure 9:
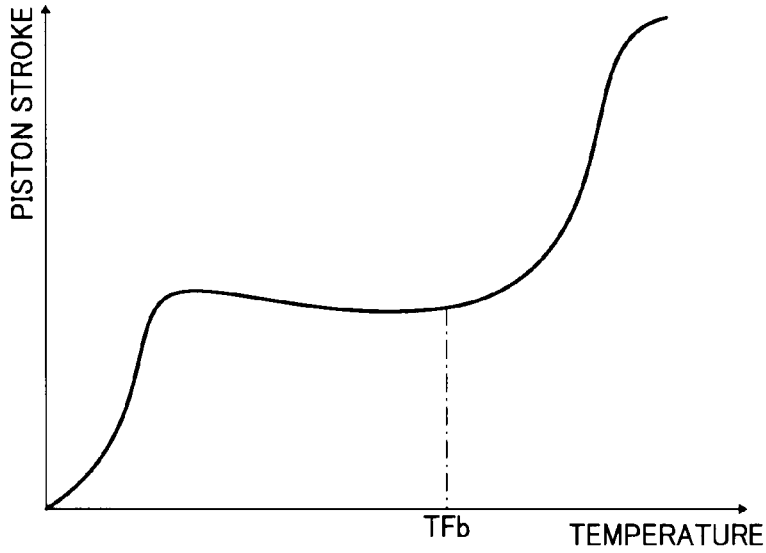
FIG. 9 is a graph illustrating a property of a toner used in the image forming apparatus according to the illustrative embodiment.

FIG. 9 is a graph showing stress change of the toner when the toner is heated as data of the toner suitable for the present invention. The graph shown in FIG. 9 shows that the toner starts to flow when heated to over a predetermined or given temperature, which is herein after referred to as a flowing start temperature (Tfb) and used as a melting start temperature. The toner used in the present embodiment can produce high quality images with enhanced transparency and saturation (brightness and gloss) and excels in powder fluidity, hot-offset resistivity, charge stability, and transfer properties, compared with a known pulverized toner.

However, the toner used in the present embodiment starts to melt at a relatively high temperature. More specifically, the toner used in the present embodiment has a flowing start temperature of 92±1° C., while a known pulverized toner has a flowing start temperature of 86±2° C. Therefore, preheating the first side of the sheet P is effective to fuse throughout a toner layer more uniformly so as to improve smoothness of a toner surface and maintain a high level of gloss.

The flowing start temperature of the toner can be measured by using a flow tester. An example of the flow tester is a Shimazu Corporation CFT-500D flow tester. A flow curve shown in FIG. 9 is obtained by using this flow meter, and various temperatures can be read therefrom. In the present embodiment, measurements were performed under conditions of a load of 5 kg/cm$^2$, a heating rate of 3.0° C./min, a die bore diameter of 1.00 mm, and a die length of 10.0 mm.

The toner used in the present embodiment is produced as follows:

A prepolymer including a modified polyester resin, a compound with which the prepolymer is capable of elongating or cross-linking, and toner components are dissolved or dispersed in an organic solvent, and then elongating or cross-linking of the dissolutions or dispersions is allowed in an aqueous medium. The toner is obtained by removing the solvent from the dispersion.

It is to be noted that "and/or" means "at least one of".

The toner used in the present embodiment includes a polyester resin as a binder, and a pigment as a colorant that disperses highly, and thus the toner can produce high quality images that excel in transparency and saturation (brightness and gloss). Further, the toner excels in powder fluidity, resistance to hot offset, charge stability, and transfer properties.

Features of the toner are described below.

1. To produce the toner, a prepolymer including a modified polyester resin, a compound with which the prepolymer elongates or cross-links, and toner components are dissolved or dispersed in an organic solvent, and thus an oil-base dissolutions or dispersion liquid is obtained. The dissolution or dispersion is allowed to elongate or cross-link in an aqueous medium, and the toner is obtained by removing the solvent from the dissolution or dispersion. The pigment (colorant) dispersed in the toner particles has a dispersion particle diameter of 0.5 μm or smaller by number average particle diameter, and a percentage of the particles having a particle diameter of 0.7 μm or greater is not greater than 5% by number.

Features 2 through 8 described below are added to the feature 1 described above independently or in combination.

2. The dispersion particle diameter of the pigment is 0.3 μm or smaller, and the percentage of the particles having a particle diameter of 0.5 μm or greater is not greater than 10% by number.

3. The toner particles have a weight average particle diameter within a range of from 3.0 to 7.0 μm and a particle distribution of $$1.00 \leqq Dv/Dn \leqq 1.20$$

wherein Dv is weight average particle diameter, and Dn is number average particle diameter.

4. Toner particles have an average circularity within a range of from 0.900 to 0.960.

5. The polyester resin included in the toner includes an element that is soluble in tetrahydrofuran (tetrahydrofuran soluble element) and has a main peak of a molecular weight distribution within a range from 2500 to 10,000, and a number average molecular weight of the tetrahydrofuran soluble element is within a range from 2,500 to 50,000.

6. The polyester resin has a glass-transition temperature (Tag) within a range of from 40° C. to 65° C. and an acid number within a range of from 1 to 30 KOH mg/g.

7. The oil-base dissolution or dispersion liquid includes a polyester resin unreactive with amine.

8. The toner described above is mixed with carrier in the developer used in the present embodiment, and can be used as both monochrome toner and color toner.

A method to manufacture the toner is described in further detail below.

At least a polyester prepolymer A containing an isocyanate group is dissolved, a pigment type colorant is dispersed, and a releasing agent is dissolved or dispersed in an organic solvent, and thus an oil-base dispersion liquid is formed. The dispersion liquid is dispersed in an aqueous medium including an inorganic fine particles and/or polymer fine particles. Further, in the dispersion liquid, the prepolymer A is allowed to react with an amine B including a polyamine and/or a monoamine containing an active hydrogen group so as to produce an urea-modified polyester resin C. Then, the liquid medium is removed from the dispersion liquid including the urea-modified polyester resin C, and thus the toner is obtained.

It is to be noted that hereinafter a dispersed material referred to as a material dissolved or dispersed in the oil-base dispersion liquid.

The urea-modified polyester resin C has a glass-transition temperature within a range of from 40° C. to 60° C., and this range is preferably from 45° C. to 60° C. Its number average molecular weight Man is within a range from 2,500 to 50,000, preferably within a range from 2,500 to 30,000, and its weight average molecular weight Mw is within a range from 10,000 to 500,000, preferably within a range from 30,000 to 100,000.

The toner includes, as a binder resin, the urea-modified polyester resin C containing an urea binding whose molecular weight is increased by the reaction between the prepolymer A and the amine B, and the colorant is dispersed highly in the binder resin.

When the pigment type colorant contained in the toner particles is controlled to have a dispersion particle diameter in number average of 0.5 μm or below, and the percentage of colorant particles having an average particle diameter of not less than 0.7 μm is controlled 5% or below by number, the toner excels in low temperature fixing properties, charge stability, and fluidity. Further, the toner can produce high quality images, particularly, color images having better transparency and gloss.

Quality of the toner can be further enhanced by controlling the pigment type colorant to have a dispersion particle diameter in number average of not greater than 0.3 μm and the percentage of pigment particles having an average particle diameter of not less than 0.5 μm to 10% or below. Because such a toner excels in image resolution, the toner is suitable for a digital developing device. In particular, color toners excel in image resolution and transparency and produce images with enhanced color reproducibility.

To obtain such a high quality toner in which the colorant is dispersed uniformly, a process to pulverize the colorant (wet-pulverization process) is required in forming the oil-base dispersion liquid including the prepolymer A, the colorant, and the releasing agent. The wet-pulverization process can be performed by any wet-pulverization machine that can pulverize the colorant in a liquid with an impact force. Examples of this wet-pulverization machine include a ball mill and a bead mill. The wet-pulverization process is preferably performed at a temperature within a range of from 5° C. to 20° C., and the range is more preferable from 15° C. to 20° C.

By adjusting conditions of the wet-pulverization process, the colorant included in the toner can be controlled to have the dispersion particle diameter and the particle diameter distribution described above. It is to be noted that the wet-pulverization process is applicable to the dispersion liquid after reaction, as required.

Further, to obtain the high quality toner described above, a method using a master batch is applicable. More specifically, the master batch is manufactured by dispersing the colorant in a resin in higher concentration, and the master batch colorant particles are added to the organic solvent as a colorant material and then dispersed therein by agitation.

By using the master batch particles, the colorant particles having a smaller dispersion particle diameter can be dispersed uniformly in the toner, and the toner can produce high quality images with better transparency. To manufacture preferable master batch particles, a mixture including a thermally melting resin and the colorant is kneaded with a higher shearing force at a melting temperature of this resin. The kneaded material is cooled to solidify, and the solidified material is then pulverized.

A preferable resin as the thermally melting resin is a thermoplastic resin having a good miscibility with the urea-modified polyester resin C that is produced by using the prepolymer A. The thermoplastic resin has a softening point within a range of from 100° C. to 200° C., more preferable, from 120° C. to 160° C., and a number average molecular weight Man within a range of from 2,500 to 50,000, more preferable, from 2,500 to 30,000. The master batch has a colorant concentration within a range of from 10% to 60% by weight, more preferably, from 25% to 55% by weight.

Described below is a measurement method of toner properties including the dispersion particle diameter of the colorant.

To measure the dispersion particle diameter and the particle diameter distribution of the colorant included in the toner, a measurement sample is prepared. To prepare the measurement sample, the toner is embedded in an epoxy resin and sliced into flakes having a thickness of about 100 nm by using a microtome MT 6000-Xl, manufacture by RMC, Inc., for example.

Several transmission electron microphotographs (TEM photos) of these measurement samples are taken by using an electron microscope, such as H-9000NAR manufacture by Hitachi, Ltd., with an accelerating voltage of 100 kV and a magnification within a range of from 10,000 to 40,000. Image information of the TEM photos is converted into image data with an image analyzer, such as a NIRECO LUZEX III. Target colorant particles that are particles having a particle diameter of not smaller than 0.1 μm are measured randomly until its sampling number exceeds 300, and then its average particle diameter and particle diameter distribution are calculated.

The toner according to the present embodiment has a weight average particle size (Dv) within a range of from 3 μm to 7 μm, and the ratio of the weight average particle size ratio (Dv) to the number average particle diameter (Dn) is $1.00 \leqq Dv/Dn \leqq 1.20$. The toner having higher resolution and image quality can be obtained by specifying the ratio of the Dv to the Dn to this range.

To enhance image quality further, the percentage of the toner particles having a particle diameter of not greater than 3 μm is controlled to within a range from 1% to 10% by number, in addition to maintaining the weight average particle diameter and the ratio of the Dv to the Dn to the range described above. More preferably, the weight average particle diameter is within a range from 3 μm to 6 μm, and the ratio of the Dv to the Dn is $1.00 \leqq Dv/Dn \leqq 1.15$. Such a toner excels in thermal and storage stability, low temperature fixing properties, and resistance to hot offset. Moreover, in the case of a two-component developer, changes in the toner particle diameter is relatively small even when consumption and supply of the toner repeated for a relatively long time period, and good developability can be maintained even when the toner is agitated in a developing device for a relatively long time period.

Although the toner having a smaller particle diameter is generally advantageous to obtain images with a higher resolution and image quality, such a toner is disadvantageous to transfer and cleaning properties. Further, when the toner has a weight average particle diameter of smaller than the range specified in the present embodiment, the following phenomena tend to occur: When such a toner is used in the two-component developer and agitated for a relatively long time period in the developing device, the toner is fused and deposits on a surface of the carrier, and thus charging ability of the carrier impaired. By contrast, when such a toner is used as one-component developer, the toner is likely to adhere to the developing roller and/or a blade to regulate a thickness of a toner layer on the developing roller.

The phenomena described above are closely related to a content rate of fine particles in the toner. In particular, when the content rate of fine particles having a particle diameter of not greater than 3 μm exceeds 10%, the toner does not easily adheres to the carrier and it is difficult to maintain a relatively high charge stability.

By contrast, when the toner has an average particle diameter of greater than the range specified in the present embodiment, it is difficult to obtain images with high resolution and image quality, and changes in the toner particle diameter in the developer is likely to increase while consumption and supply of the toner included in the two-component developer are repeated. Further, this is also applicable when the ratio of the Dv to the Dn is greater than 1.20.

The average particle diameter and the particle diameter distribution of the toner are measured through the Coulter counter method. Examples of an instrument to measure the particle distribution of the toner particles include Coulter Counter TA-II and Coulter Multisizer II both manufactured by Beckman Coulter, Inc. In the present embodiment, Coulter Counter TA-II was used and connected to an interface to output number distribution and volume distribution, manufactured by The Institute of Japanese Union of Scientists and Engineers and a NEC PC9801 personal computer in the measurement.

The measurement of the number distribution and the volume distribution of the toner are described below. As a dispersant, 0.1 ml to 5 ml of a surfactant, preferably an alkylbenzene sulfonic acid, is added to 100 ml to 150 ml of an electrolyte. It is to be noted that the electrolyte refers to a sodium chloride solution having an elemental sodium content of about 1% that is produced by using a first grade sodium chloride, such as a Beckman Coulter ISOTON-II.

Further, 2 to 20 mg of the toner is added to the electrolyte as a test sample, and then the electrolyte in which the tone is suspended is dispersed with an ultrasonic disperser for a time period from 1 min to 3 min. The volume and the number of the toner particles are measured by using the instrument described above with an aperture of 100 μm so as to determine the weight distribution and the number distribution thereof.

Target particles were particles having a particle diameter within a range of from 2.00 μm to 40.30 μm, and the measurement was performed using 13 channels of: 2.00 μm to 2.52 μm; 2.52 μm to 3.17 μm; 3.17 μm to 4.00 μm; 4.00 μm to 5.04 μm; 5.04 μm to 6.35 μm; 6.35 μm to 8.00 μm; 8.00 μm to 10.08 μm; 10.08 μm to 12.70 μm; 12.70 μm to 16.00 μm; 16.00 μm to 20.20 μm; 20.20 μm to 25.40 μm; 25.40 μm to 32.00 μm; and 32.00 μm to 40.30 μm.

The ratio of the Dv to the Dn was calculated based on the weight average particle diameter (Dv) obtained from the volume distribution and the number average particle diameter (Dn) obtained from the number distribution.

To improve the resistance to hot offset, various methods have been proposed including controlling the molecular weight distribution of the binder resin. Methods to balance low temperature fixing properties and resistance to hot offset, which contradict each other, includes the following methods. One method uses a binder resin having a broader molecular weight distribution. Another method uses a mixture resin that has at least two molecular weight peaks and includes a component having a higher molecular weight of within range from several hundred thousands to several millions and another component having a lower molecular weight within a range of from several thousands to several tens of thousands.

When a component of a higher molecular weight has a cross-linking structure or in a state of gel, it is more effective to prevent hot offset. However, for a full color toner, which requires high gloss and transparency, using a large amount of such a higher molecular weight component is not preferable. In the present embodiment, the toner can have a higher resistance to hot offset as well as higher gloss and transparency, by including urea-modified polyester resin having an area-connection whose molecular weight is relatively high.

In the present embodiment, the molecular weight distribution of the binder resin is measured by using GPC (gel permeation chromatography) as described below.

A column is stabilized in a heat chamber at a temperature of 40° C. As a column solvent to be used under this temperature, THF (Tetrahydrofuran) is put into the column at a speed of 1 ml/min. A THF sample solution of the resin is adjusted to have a concentration within a range of from 0.05% to 0.6% by weight, 50 μl to 200 μl of the THF solution is added in the column. Prior to the measurement, a calibration curve is prepared using several standard polystyrene samples having a single distribution peak. The molecular weight distribution of the sample is determined based on a relation between logarithmic values of the calibration curve and a count number. As the standard polystyrene samples that can be used to create the calibration curve, for example, the samples having a molecular weight of $6\times10^2$, $2.1\times10^3$, $4\times10^2$, $1.75\times10^4$, $5.1\times10^4$, $1.1\times10^5$, $3.9\times10^5$, $8.6\times10^5$, $2\times10^6$ and $4.48\times10^6$ from Pressure Chemical Co. or Tosoh Corporation are used. It is preferable to use at least 10 standard polystyrene samples. As the detector, an RI (refraction index) detector is used.

The binder component included in the toner typically has a molecular weight main peak of within a distribution range from 2,500 to 10,000, preferably within a range from 2,500 to 8,000, and more preferably within a range from 2,500 to 6,000.

If a component having a molecular weight of less than 1,000 increases in volume, thermal and storage stability tends to degrade. By contrast, if a component having a molecular weight of greater than 30,000 increases in volume, although low temperature fixing properties tend to degrade, this degrading can be limited by controlling balance.

The content of the component having a molecular weight of greater than 30,000 is within a range from 1% to 10%, and this content is preferably within a range from 3% to 6% although this depends on toner materials. If this content is less than 1%, resistance to hot offset is insufficient, and if this content exceeds 10%, gloss and transparency are impaired. The binder resin included in the toner has a number average molecular weight Mn within a range of from 2,500 to 50,000, and a ratio of its weight average molecular weight Mw to the number average molecular weight Mn is not greater than 10. When this ratio (Mw/Mn) is greater than 10, its sharp melting property is insufficient and gloss is impaired.

The circularity of the toner is measured by a flow-type particle image analyzer FPIA-2000 from SYSMEX CORPORATION, for example. The toner according to the present embodiment has an average circularity within a range of from 0.900 to 0.960. It is important that the toner has a specific shape and a specific shape distribution.

If the average circularity is less than 0.900, because the toner particles are amorphous and have insufficient transfer properties, it is difficult to obtain high quality images without toner scattering. Such amorphous toner particles have many contact points with a smooth member such as the photoreceptor. Further, because electric charge tends to concentrate on projection tips, such toner particles have higher Van der Waals' forces and a higher mirror image force compared with relatively spherical toner particles. Therefore, if the toner includes both spherical particles and amorphous particles, the toner is partially absent in a character portion and/or a line portion of a resulting image because spherical particles are selectively transferred in the electrostatic transfer process. Further, a cleaner is required to remove the remaining toner that is not transferred, and toner yield, which is a ratio of the toner used to form an image to total, is relatively low.

In the present embodiment, the circularity of the pulverized toner is typically within a range from 0.910 to 0.920 when measured by the analyzer described above.

Measurement of the toner shape (circularity) is described below.

A suitable method is an optical detection method in which a suspension liquid including particles is passed through a plate-shaped imaging detector, and an image of the particles is optically detected with a CCD (charge-coupled device) camera. From this method, projection area of the particle is available. The circularity is a value obtained by dividing a circumference of a circle having an area identical with this projection area by a circumference of an actual particle. This value is the average circularity measured by the flow-type particle image analyzer FPIA-2000 as described above.

The method is described below in details.

In a container, 100 ml to 150 ml of water from which impure solid materials are previously removed is put, and 0.1 ml to 0.5 ml of a surfactant as a dispersant, preferably an alkylbenzene sulfonic acid, and further 0.1 g to 0.5 g of the toner (sample) are added thereto. The suspension liquid including the sample is dispersed with an ultrasonic disperser for 1 min to 3 min, and then a dispersion liquid having a concentration within a range of from 3,000 to 10,000 pieces/μl is prepared. The shape and shape distribution of the toner in the dispersion liquid is measured with the instruments described above.

As described above, the toner manufacturing method according to the present embodiment includes a molecular weight increasing process. In the process, the polyester prepolymer A containing an isocyanate group is dispersed in an aqueous medium including an inorganic fine particles and/or polymer fine particles, and allowed to react with the amine B.

To manufacture the polyester prepolymer A containing an isocyanate group, a polyester having an active hydrogen group that is formed through polycondensation between polyol (PO) and polycarboxylic acid (PC) is further reacted with polyisocyanate (PIC).

Examples of the active hydrogen contained in the polyester include a hydroxyl group (an alcoholic hydroxyl group and a phenolic hydroxyl group), an amino group, a carboxyl group, and a mercapto group. In particular, the alcoholic hydroxyl group is preferably used.

As polyol (PO), diol (DIO) and a polyol having 3 or more valences (TO) can be used. As a preferable polyol, the diol alone or a mixture of the diol and a small amount of the TO is used.

Examples of diol include alkylene glycol such as ethylene glycol, 1,2-propylene glycol; bisphenol such as bisphenol A, bisphenol F and bisphenol S; and adducts of the bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used.

Examples of the TO having 3 or more valences include multivalent aliphatic alcohol having 3 to 8 valences or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarboxylic acid (PC), dicarboxylic acid (DIC) and polycarboxylic acid having 3 or more valences (TC) can be used, and DIC alone, or a mixture of DIC and a small amount of TC are preferably used. Examples of DIC include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Examples of TC include aromatic polycarboxylic acids having 9 to 20 carbon atoms such as trimellitic acid and pyromellitic acid. Polycarboxylic acid (PC) can be formed from a reaction between polyol (PO) and the above-mentioned acids anhydride or lower alkyl ester such as methyl ester, ethyl ester and isopropyl ester.

As a ratio between polyol (PO) and polycarboxylic acid (PC), an equivalent ratio [OH]/[COOH] between a hydroxyl group [OH] and a carboxylic group [COOH] is typically within a range from 2/1 to 1/1, preferably within a range from 1.5/1 to 1/1, and more preferably within a range from 1.3/1 to 1.02/1.

Examples of polyisocyanate (PIC) include aliphatic polyisocyanate such as tetramethylenediisocyanate, hexamethylene diisocyanate and 2,6-diisocyanate methylcaproate; alicyclic polyisocyanate such as isophorone diisocyanate and cyclohexylmethane diisocyanate; aromatic diisocyanate such as tolylene isocyanate and diphenylmethane diisocyanate; aroma aliphatic diisocyanate such as α, α, α', α'-tetramethylxylylene diisocyanate; isocyanurate; the above-mentioned polyisocyanate blocked with phenol derivatives, oxime and caprolactam; and their combinations.

As a ratio between polyisocyanate (PIC) and polyester (PE) resin in manufacturing the polyester prepolymer A, an equivalent ratio [NCO]/[OH] between an isocyanate group [NCO] and the polyester having a hydroxyl group [OH] is typically within a range from 5/1 to 1/1, preferably within a range from 4/1 to 1.2/1, and more preferably within a range from 2.5/1 to 1.5/1.

When the equivalent ratio [NCO]/[OH] is greater than 5, low temperature fixing properties of the resultant toner are impaired. When a molar ratio of the isocyanate group [NCO] is less than 1, a urea content in ester of the modified polyester decreases and resistance to hot offset of the toner is impaired.

The content of a polyisocyanate component in the polyester prepolymer A that contains a isocyanate group at its end portion is within a range from 0.5% to 40% by weight, preferably within a range from 1% to 30% by weight, and more preferably within a range from 2% to 20% by weight. When the content is less than 0.5% by weight, in the resultant toner, resistance to hot offset as well as the thermal and storage stability and low temperature fixing properties are impaired. By contrast, when the content is greater than 40% by weight, low temperature fixing properties of the toner are impaired.

In one molecule of the polyester prepolymer A, typically more than one isocyanate group is included. The number of this isocyanate group is preferably from 1.5 to 3 on average, and more preferably from 1.8 to 2.5 on average. When less than one isocyanate group is included in one molecule of the polyester prepolymer A, the molecular weight of the urea-modified polyester decreases and resistance to hot offset of the toner is impaired.

As the amine B, a polyamine and/or a monoamine containing an active hydrogen group is used as described above. The active hydrogen group includes a hydroxyl group and/or a mercapto group. Examples of the amine B include diamines B1 such as aromatic diamines (e.g., phenylene diamine, diethyltoluene diamine, and 4,4'-diaminodiphenyl methane); and polyamines (B2) having three or more amino groups such as diethylene triamine and triethylene tetramine. Among these compounds, the diamines (B1) and mixtures of a diamine and a small amount of a polyamine (B2) are preferably used.

In the reaction between the prepolymer A and the amine B, the molecular weight of the polyester can be controlled by using an elongation anticatalyst, as required. Examples of the elongation anticatalyst include monoamines having no active hydrogen groups such as diethyle amine, dibutyl amine, butyl amine and lauryl amine; and compounds prepared by blocking these monoamines, such as ketimine compounds. An amount of the anticatalyst to be used in this reaction is determined in relation to a preferable molecular weight of the resultant urea-modified polyester.

A ratio between the prepolymer A and the amine B is designated by an equivalent ratio of the isocyanate groups [NCO] included in the prepolymer A to the amino groups

[NHx] included in the amine B. This ratio [NCO]/[NHx] is typically within a range from 1/2 to 2/1, preferably within a range from 1.5/1 to 1/1.5, and more preferably within a range from 1.2/1 to 1/1.2. When the ratio [NCO]/[NHx] is greater than 2 or less than 1/2, molecular weight of the polyester decreases, resulting in deterioration of resistance to hot offset.

In the toner manufacturing method according to the present embodiment, when the prepolymer A containing an isocyanate group is reacted with the amine B in an aqueous medium, a polyester resin D that is unreactive with amine can be used, as required. The polyester resin D has a glass-transition temperature within a range of from 35° C. to 65° C., preferably within a range from 45° C. to 60° C., and a number average molecular weight within a range of from 2,000 to 10,000, preferably within a range from 2,500 to 8,000.

As the polyester resin D, a urea-modified polyester (UMPE) can be used, and the urea-modified polyester may include an urethane bonding in addition to a urea bonding.

A molar ratio of the urea bonding component to the urethane bonding component is within a range from 100/0 to 10/90, preferably within a range from 80/20 to 20/80, and more preferably within a range from 60/40 to 30/70. When the molar ratio of the urea bonding component is less than 10%, resistance to hot offset of the toner is impaired.

The urea-modified polyester can be produced by a known method such as a one-shot method. The urea-modified polyester has a weight average molecular weight of not less than 10,000, preferably within a range from 20,000 to 500,000, and more preferably within a range from 30,000 to 100,000. When the weight average molecular weight is less than 10,000, resistance to hot offset is impaired.

In the toner manufacturing method according to the present embodiment, the urea-modified polyester (UMPE) that is used as required (polyester resin D) can be used alone, and alternatively, an unmodified polyester resin (PE) can be included as a toner binder component in combination with the urea-modified polyester (UMPE). Using the UMPE and the PE in combination is preferable because low temperature fixing properties of the toner and gloss of color images produced therewith can be improved.

Examples of the unmodified polyester resin (PE) include polycondensation products of polyol (PO) and polycarboxylic acid (PC) that are similar to the polyester component of the UMPE. The unmodified polyester (PE) has a preferable weight average particle diameter Mw that is similar to that of urea-modified polyester resin (UMPE), as described above. Alternatively, instead of the unmodified polyester resin, polyester resins modified by a chemical bonding except for urea bonding, such as urethane bonding, can be used with UMPE.

It is preferable that the unmodified polyester and the urea-modified polyester are partially soluble with each other to improve low temperature fixing properties and resistance to hot offset of the resultant toner. Therefore, the unmodified polyester and the urea-modified polyester preferably have similar structures. When the unmodified polyester is used, a weight ratio of the urea-modified polyester to the unmodified polyester (UMPE/PE) is typically within a range from 5/95 to 80/20, preferably within a range from 5/95 to 30/70, and more preferably within a range from 5/95 to 25/75. It is further preferable when this ratio is within a range from 7/93 to 20/80. When the weight ratio of the urea-modified polyester resin is less than 5%, the resultant toner has poor resistance to hot offset, and it is disadvantageous to balance thermal and storage stability and low temperature fixing properties.

The unmodified polyester resin (PE) preferably has a hydroxyl value not less than 5 mg KOH/g and an acid value within a range of from 1 mg KOH/g to 30 mg KOH/g, more preferably within a range from 5 mg KOH/g to 20 mg KOH/g. The PE having such an acid value easily becomes negatively charged, and the resultant toner has good affinity with a paper and low temperature fixing properties are improved. However, when the acid value is greater than 30 mg KOH/g, chargeability of the resultant toner is impaired particularly due to changes in environmental conditions. In a polyaddition reaction, fluctuation of the acid value causes a crush of particles in a granulation process and it is difficult to control emulsification.

In the present embodiment, the toner binder has a glass-transition temperature within a range of from 45° C. to 60° C., more preferably within a range from 45° C. to 60° C. Heat resistivity is impaired when this glass-transition temperature is lower than 45° C., and low temperature fixing properties are impaired when this glass-transition temperature exceeds 65° C.

Examples of the colorant for use in the toner manufacturing method according to the present embodiment include various known dyes and pigments such as carbon black, Nigrosine dyes, anthraquinone green, titanium oxide, zinc oxide, lithopone, and mixtures of these. The content of the colorant in the toner is typically within a range from 1% to 15% by weight, preferably within a range from 3% to 10% by weight.

As described above, it is preferable to use the master batch colorant particles in which the colorant is combined with the resin. Examples of the binder resin to be used with the colorant in manufacturing the master batch include the modified and unmodified polyester resins described above, polystyrene, terpene resins, aliphatic or alicyclic hydrocarbon resins, and aromatic petroleum resins. These resins can be used alone or in combination.

The master batch is typically prepared by mixing and kneading the resin and the colorant with high shear stress. In this time, an organic solvent can be used to enhance the interaction of the colorant with the resin. Alternatively, flushing methods can be used in which an aqueous paste including a colorant is mixed with a resin solution of an organic solvent so as to transfer the colorant to the resin solution, and then the aqueous liquid and organic solvent are separated and removed therefrom. These methods are preferable because the resultant wet cake of the colorant can be used as it is. To knead and mix the resin and the colorant, a three-roll mill applying high shear stress is preferably used.

In the toner, a releasing agent is included as wax together with the toner binder and the colorant, and various known releasing agents can be used. Examples of the releasing agent include polyolefin, long-chain hydrocarbon, and waxes including a carbonyl group. Among these, the carbonyl group containing waxes are preferable, and examples thereof include polyalkanoic acid ester, polyalkanol ester, and dialkyl ketone such as distearyl ketone. Among these carbonyl group containing waxes, polyalkanoic acid ester is preferable.

The wax typically has a melting point within a range of from 40° C. to 160° C. This range is preferably within a range from 50° C. to 120° C., and more preferably within a range from 60° C. to 90° C. The wax adversely affects thermal and storage stability if its melting point is lower than 40° C., and the wax is likely to cause cold offset in fixing at a lower temperature if its melting point is higher than 160° C.

Further, the wax preferably has a melt viscosity within a range of from 5 cps (centipoise) to 1,000 cps, more preferably within a range from 10 cps to 100 cps, as a measurement value at a temperature higher by 20° C. than its melting point. If the wax has a melt viscosity greater than 1,000 cps, the wax does not contribute much to the improvement of resistance to hot offset and low temperature fixing properties. The content of the wax in the toner is typically within a range from 0 to 40% by weight, and this range is preferably from 3% to 30% by weight.

The toner used in the present embodiment may optionally include a charge controller. Examples of the charge controller include various known charge controllers such as Nigrosine dyes, triphenylmethane dyes, quinacridone, azo pigments, and polymers having a functional group such as a sulfonate group, a carboxyl group, a quaternary ammonium group, etc.

The content of the charge controller depends on the type of the binder resin, whether or not an additive is added, and the toner manufacturing methods (such as dispersion method), and is not particularly limited. Typically, the content of the charge controller is within a range from 0.1 to 10 parts by weight, and preferably within a range from 0.2 to 5 parts by weight, to 100 parts by weight of the binder resin.

If the content is greater than 10 parts by weight, the toner has excessive chargeability, and thus main effects of the charge controller is impaired. Further, the electrostatic force of a developing roller attracting the toner increases, and thus fluidity of the toner and image density are decreased. These charge controller and releasing agent can be kneaded together with the master batch pigment and the resin. Alternatively, the charge controller and the release agent can be added when such toner constituents are dissolved or dispersed in the organic solvent.

To improve the toner in fluidity, developability, and chargeability, an additive can be externally added to the toner particles. Inorganic particulate materials are preferable as the external additive. The inorganic particulate material preferably has a primary particle diameter within a range of from 5 nm to 2 μm, and more preferably within a range from 5 nm to 500 nm. Further, the inorganic particulate material preferably has a specific surface area within a range of from 20 $m^2/g$ to 500 $m^2/g$ determined through the BET (Brunauer, Emmett and Teller) method.

An amount of the inorganic particulate material used in the toner is preferably within a range from 0.01% to 5% by weight, more preferably within a range from 0.01% to 2.0% by weight. Example of the inorganic particulate material include silica and silicon nitride.

Alternatively, polymer particulate materials can be used instead of inorganic particulate materials. Examples of inorganic particulate materials include polystyrene formed by a soap-free emulsion polymerization, a suspension polymerization, or a dispersion polymerization; ester methacrylate; ester acrylate copolymer; polycondensates such as silicone, benzoguanamine, and nylon; and polymeric particulate materials formed of thermosetting resins.

For such an external additive, a surface treatment agent can be used to increase the hydrophobic properties so as to prevent deterioration of fluidity and chargeability even in an high humidity environment. Preferable examples of the surface treatment agent include a silane coupling agent, a sililation agent, a silane coupling agent having an alkyl fluoride group, an organic titanate coupling agent, an aluminum coupling agent, silicone oil, and a modified silicone oil.

A cleaning improver can be used to better remove the developer remaining on the photoreceptor or a primary transfer medium after the transfer process. Examples of the cleaning improver includes fatty acid metallic salts such as zinc stearate, calcium stearate, and stearic acid; and polymer particles prepared by, for example, a soap-free emulsifying polymerization method, such as polymethyl methacrylate particles, and polystyrene particles. The polymer particles relatively have a narrow particle diameter distribution and preferably have a volume average particle diameter within a range of from 0.01 μm to 1 μm.

Procedure of the toner manufacturing method according to the present embodiment is described below.

Firstly, in an organic solvent, the isocyanate group containing polyester prepolymer A is dissolved, the colorant is dispersed, and the releasing agent is dissolved or dispersed, and thus the oil-base dispersion liquid is prepared (oil-base dispersion liquid preparation process). Then, in the wet-pulverization process, the oil-base dispersion liquid is put in an wet-pulverization machine to pulverize and uniformly disperse the colorant. The pulverization time is within a range from about 30 min to 120 min.

Subsequently to the wet-pulverization process, a dispersion process (emulsification process) and a reaction process are performed. More specifically, in the dispersion process, the oil-base dispersion liquid is dispersed or emulsified in an aqueous medium that includes inorganic particulate and/or polymer particulates so as to produce an oil-in-water dispersion liquid (emulsion liquid). Further, the isocyanate group containing polyester prepolymer A is reacted with the amine B so as to produce the urea-modified polyester resin C including an urea binding in the reaction process.

The organic solvent to be used in an organic solvent is such an organic solvent hat can dissolve a polyester resin therein and is insoluble to water or has a lower solubility to water. The organic solvent typically has a boiling point within a range of from 60° C. to 150° C., and the boiling point is preferably within a range from 70° C. to 120° C. Examples of the organic solvent include ethyl acetate and methylethyl ketone.

As described above, it is preferable to use the master batch colorant particles as the colorant so as to efficiently disperse the colorant uniformly.

In the present embodiment, it is preferable to dissolve the polyester resin D that is unreactive with amine in the organic solvent, as an adjuvant. Further, the polyester resin D may be dispersed in an aqueous medium.

A dispersion machine to dispersed the oil-base dispersion liquid in an aqueous medium is not particularly limited, and the examples of the dispersion machine includes known mixers and known dispersion machines such as low shearing force type dispersing machines, high shearing force type dispersing machines, friction type dispersing machines, high pressure jet type dispersing machines, and ultrasonic dispersing machine. In order to prepare particles having an average particle diameter within a range of from 2 μm to 20 μm, high shearing force type dispersion machines are preferably used. When high shearing force type dispersion machines are used, the rotation speed is generally within a range from 1,000 rpm to 30,000 rpm and preferably within a range from 5,000 rpm to 20,000 rpm, but is not limited thereto. Further, the dispersion time is generally within a range from 0.1 min to 5 min for a batch type machine, but is not limited thereto. The dispersion process is typically performed at a temperature within a range of from 0 to 150° C. (under pressure), and this range is preferably within a range from 40° C. to 98° C. In order to easily disperse the oil-base dispersion liquid in an aqueous medium, a higher temperature is preferable because the viscosity thereof is lower.

The content of the aqueous medium to 100 parts by weight of the toner solid components including the prepolymer A, the colorant, the releasing agent, and the polyester resin D, is typically from 50 to 2,000 parts by weight, and preferably from 100 to 1,000 parts by weight. When the content is less than 50 parts by weight, the toner solid components are inadequately dispersed in the aqueous medium, and thus the particle diameter of the resultant toner particles are inadequate.

By contrast, when the content is greater than 2,000, the production cost is not practical. As required, a dispersant can be used. Using a dispersant is preferable to have a sharp particle diameter distribution as well as stable dispersion. It is preferable to immediately disperse the oil-base dispersion liquid in the aqueous liquid after the wet-pulverization process.

As the aqueous medium, water can be used alone, and alternatively, a solvent miscible with water can be mixed with water. Examples of such a water-miscible solvent include alcohols such as methanol, isopropanol and ethylene glycol; dimethylformamide; tetrahydrofuran; cellosolves such as methyl cellosolve; and lower ketones such as acetone, and methyl ethyl ketone.

To disperse or emulsify the oil-base phase including the toner solid components in the aqueous medium, various surfactants (emulsifier) can be used as dispersants. Examples of such dispersants include anionic surfactants such as alkylbenzene sulfonic acid salts, a-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N, N-dimethylammonium betaine.

Further, in the case of a surfactant including a fluoroalkyl group, even a relatively small amount of the surfactant is effective. Examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Example of commercially available surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Examples of the cationic surfactants include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Examples of commercially available such cationic surfactants include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

As the inorganic particulate to be included in the aqueous medium, various known inorganic particulates that are insoluble to water or has a relatively low water-solubility can be used. Examples of such inorganic particulates include tricalcium phosphate, calcium carbonate, titanium oxide, colloidal silica and hydroxyapatite.

As the polymer particulate, various known polymer particulates that are insoluble to water or has a relatively low water-solubility can be used. Examples of such polymer particulates include hydrophobic macromolecular particulates such as carbon hydride resins, fluorine-containing resins, and silicone resins.

The particulates described above typically have a particle diameter smaller than that of the toner particles. For the uniformity of the particle diameter, the ratio of the volume average particle diameter of the particulates to that of the toner particles is preferably within a range from 0.001 to 0.3. If this ratio is greater than 0.3, the particulates are not efficiently absorbed on the surfaces of the toner particles, and thus the toner tends to have a broader particle diameter distribution.

The volume average particle diameter of the particulates can be adjusted so as to obtain the toner having a preferable particle diameter, as long the particle diameter ratio described above is satisfied. For example, to obtain the toner having a volume average particle diameter of 5 μm, the volume average particle diameter of the particulates is preferably within a range of from 0.0025 μm to 1.5 μm, and more preferably within a range from 0.005 μm to 1.0 μm. By contrast, to obtain the toner having a volume average particle diameter of 10 μm, the volume average particle diameter of the particulates is preferably within a range of from 0.005 μm to 3 μm, and more preferably within a range from 0.05 μm to 2 μm.

Further, as a dispersion stabilizer, various hydrophilic polymeric substances that form polymeric protection colloid therein may be included in the aqueous medium. Examples of a monomer component of such polymeric substances include acids such as acrylic acid and methacrylic acid; and vinyl monomers having a nitrogen atom or a nitrogen heterocycle such as vinyl imidazole and ethylene imine. Other polymeric substances that can be preferably used in the present embodiment includes polyoxyethylene compounds such as polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters; and cellulose compounds such as methyl cellulose, hydroxyethyl cellulose, and hydroxypropyl cellulose.

In a process to remove the liquid medium from the emulsion dispersion obtained after the polyaddition reaction between the prepolymer A and the amine B (liquid medium removal process), an adoptable method includes a process in which an entire system is gradually heated so as to evaporate and remove the organic solvent. The circularity of the toner can be controlled by adjusting liquid agitation before the organic solvent is removed and a removal time of the organic solvent.

More specifically, when the organic solvent is slowly removed from the emulsion dispersion, the toner particles is more spherical with a circularity of greater than 0.980. By contrast, when the dispersion liquid is strongly agitated and the organic solvent is removed from the emulsion dispersion in a relatively short time period, the toner particles have rough surfaces and are amorphous with a circularity within a range of from 0.900 to 0.950.

Further, when the liquid medium is removed while the emulsion dispersion, obtained after the dispersion and the reaction, is agitated relatively strongly in an agitation tank at a temperature within a range of from 30° C. to 50° C., the toner circularity can be controlled within a range from 0.850 to 0.990. This is because the organic solvent, such as ethyl acetate, etc., is quickly removed during granulation, and thus the volume is contracted.

Alternatively, in another method adoptable in the liquid medium removal process, while the emulsion dispersion is sprayed in a dry atmosphere and the organic solvent is completely removed so as to form the toner particles, the aqueous dispersant is evaporated and removed. The atmosphere into which the emulsion dispersion is sprayed includes gases obtained by heating air, nitrogen, carbon dioxide, and combustion gas, and gases preferable used are various airflows that are heated to a temperature higher than a highest boiling point among boiling points of the liquid media used in the dispersion liquid. A high quality toner can be manufactured through a short period process by a spray drier, a belt drier, a rotary kiln, etc.

It is to be noted that the liquid medium removal process is preferably performed immediately after the reaction of the dispersion liquid, and is typically performed within 25 hours after the reaction.

When a substance that is soluble in acid or alkaline, such as calcium phosphate, is used as inorganic particulates, such inorganic particles can be dissolved in acid or alkaline so as to be removed from the toner particles. For example, calcium phosphate is dissolved with an acid such as a hydrochloric acid, and then the toner particles are washed with water to remove the calcium phosphate therefrom. Alternatively, inorganic particulates may be removed by an enzymatic hydrolysis.

When a dispersant is used, although the dispersant may be allowed to remain on the surfaces of the toner particles, for chargeability of the toner, such a dispersant is preferably washed off from the toner particles after the reaction between the prepolymer A and the amine B.

Further, in order to reduce viscosity of the dispersion liquid after the reaction, a solvent capable of dissolving the prepolymer A, the area-modified polyester, etc., can be included in the aqueous medium. Using such a solvent is preferable because the resultant particles have a relatively sharp particle diameter distribution.

The solvent is preferably volatile and has a boiling point lower than 100° C. so as to be removed easily. Examples of such a solvent include toluene, xylene, benzene, carbon tetrachloride, methylene chloride, and 1,2-dichloroethane, and these can be used alone or in combination. In particular, aromatic solvents such as toluene and xylene; and halogenated hydrocarbons such as methylene chloride, 1,2-dichloroethane, chloroform, and carbon tetrachloride are preferably used. Usage of such a solvent is from 0 to 300 parts by weight, preferably from 0 to 100, and more preferably from 25 to 70 parts by weight, to 100 parts by weight of the prepolymer A. After the reaction between the prepolymer A and the amine B, such a solvent is heated under a normal or reduced pressure to be removed from the dispersion liquid.

A reaction time period between the prepolymer A and the amine B is determined based on reactivity that depends on combination of the prepolymer A and the amine B, and is typically within a range from 10 minutes to 40 hours and preferably within a range from 2 hours to 24 hours. A temperature under which the prepolymer A reacts with the amine B (reaction temperature) is typically within a range from 0° C. to 150° C., and preferably within a range from 40° C. to 98° C. As required, a known catalyst such as dibutyltinlaurate and dioctyltinlaurate can be used.

When the toner particles in the emulsion dispersion has a relatively broad particle distribution after the reaction between the prepolymer A and the amine B, and the toner particles are to be cleaned and dried with such a particle distribution maintained, the toner particles can be classified into a preferred distribution.

To classify the toner particles, a particulate portion is removed in the liquid by using a cyclone separator, a decanter, a centrifugal separation, etc. Although the toner particles may be classified after being dried into powder, the classification can be performed more effectively in the liquid. The removed unnecessary particulates and/or rough particles can be reused in a kneading process to form toner particles, regardless of its being wet or dry.

It is to be noted that the dispersant is preferably removed from the dispersion liquid as much as possible, preferably while the classification is performed.

When the dried toner particles are mixed with a different type of particles, such as releasing agent particles, charging control particles, and fluidizing particles, by giving a mechanical impact to the mixed powder, the different type of particles can be fused on the surfaces of the toner particles so as not to separate therefrom.

For example, such a mechanical impact may be given to the mixed powder by a blade rotating at a high speed. Alternatively, the mixed powder is put in a high-speed airstream and is crashed into a impinging plate. Examples of machines to give a mechanical impact include a Hosokawa Micron Ong mill, a Nippon Pneumatic mill that is modified to have a reduced pulverization air pressure, a Nara Machinery hybridization system, a Cryptron system manufactured by Kawasaki Heavy Industries Ltd., and automatic mortars.

When the toner according to the present embodiment is used in a two-component developer, the toner is mixed with an magnetic carrier. A ratio of the toner is preferably within a range from 1 to 10 parts by weight to 100 parts by weight of the magnetic carrier. Examples of the magnetic carrier includes iron powders, ferrite powders, magnetite powders, magnetic resin carriers that have a particle diameter within a range of from about 20 μm to 200 μm. A surface of the carrier may be coated by a silicone resin, a fluorine-containing resin. Further, such a resin coat can include a electroconductive powder, as required. Examples of the electroconductive powder includes metal powder, carbon black, titanium oxide, and zinc oxide. Such a electroconductive powder preferably has an average particle diameter of not greater than 1 μm. When its particle diameter is larger than 1 μm, it is hard to control electrical resistance of the resultant toner.

Alternatively, the toner according to the present embodiment can be used as a one-component developer or a non-magnetic toner.

The toner according to the present embodiment is further described below using examples. Hereinafter "part(s) refer to "part(s) by weight". Characteristics of the toner of the examples are shown in FIG. 10.

EXAMPLE 1

In the example 1, a polyester to be added was manufactured as follows: In a reaction tank provided with a cooling pipe, an agitator, and a nitrogen introduction pipe, 690 parts of bisphenol A with 2 moles of ethylene oxide and 230 parts of terephthalic acid were reacted with each other for 10 hours at a temperature of 210° C., under normal pressure, and thus polycondensed. The reaction was further continued for 5 hours under a reduced pressure within a range of from 10 mmHg to 15 mmHg, and cooled to a temperature of 160° C. The mixture was further reacted for 2 hours with 18 parts of phthalic anhydride added thereto, and thus unmodified polyester (a) having a weight average molecular weight (Mw) of 85,000 was obtained.

In the example 1, a prepolymer was prepared as follows: In a reaction tank provided with a cooling pipe, an agitator, and a nitrogen introduction pipe, 800 parts of bisphenol A with 2 moles of ethylene oxide and 160 parts of isophthalic acid, 60 parts of terephthalic acid, and 2 parts of dibutyl tin oxide were reacted with each other for 8 hours at a temperature of 230° C., under normal pressure, and were further reacted for 5 hours while being dehydrated under a reduced pressure within a range of from 10 mmHg to 15 mmHg. Then, the mixture was cooled to a temperature of 160° C. and further reacted for 2 hours with 32 parts of phthalic anhydride added thereto. The mixture was then cooled to a temperature of 80° C. Further, the mixture was reacted with 170 parts of isophorone diisocyanate in ethyl acetate for 2 hours, and thus an isocyanate group containing prepolymer 1 having a weight average molecular weight of 35,000 was obtained.

In the example 1, a ketimine compound was prepared as follows: In a reaction tank provided with an agitation bar and a thermometer, 30 parts of isophorone diamine and 70 parts of methylethyl ketone were reacted with each other for 5 hours at a temperature of 50° C., and thus ketimine compound 1 was produced.

In the example 1, a toner was prepared as follows: In a beaker, 14.3 parts of the prepolymer 1, 55 parts of the polyester (a), and 78.6 parts of ethyl acetate were agitated and solved. Further, 10 parts of a rice wax that was a releasing agent having a melting point of 83° C., and 4 parts of copper phthalocyanine blue pigment were added to the mixture. Then, the mixture was agitated for 5 minutes at a temperature of 40° C. by a TK homomixer at a revolution of 12,000 rpm, and pulverized by using a beads mill for 30 minutes at a temperature of 20° C., and thus a oil-base dispersion 1 was obtained.

In a beaker, 306 parts of ion-exchanged water, 265 parts of 10% tricalcium phosphate suspension liquid, and 0.2 part of sodium dodecylbenzenesulfonate were put. While the mixture was agitated by a TK homomixer at a revolution of 12,000 rpm as an aqueous dispersion liquid 1, the oil-base dispersion 1 and 2.7 parts of the ketimine compound 1 were added thereto and urea-reaction was induced.

After the reaction, the organic solvent was removed from the dispersion liquid having a viscosity of 3,500 mP·s (milli-Pascal second) at a temperature of not higher than 50° C. under a reduced pressure within 1 hour. The dispersion liquid was then filtered, washed, dried, and classified with air, and thus spherical mother toner particles 1 were obtained.

Further, 100 parts of the mother particles 1, 0.25 part of a charge controller, BONTRON E-84 manufactured by Orient Chemical Industries Co., Ltd., were mixed together in a Q-type mixer manufactured by Mitsui Mining Co., Ltd., with a peripheral speed of turbine blades set to 50 m/s. In this process, a two-minutes mixing and a one-minute halt were repeated for 5 cycles, and a total operation time was 10 minutes. Further, 0.5 part of hydrophobic silica, H2000 manufacture by Clariant Japan, was mixed with the mixture for performing 5 cycles of 30-second mixing at a peripheral speed of 15 m/s and a 1-minute haut.

Thus, a cyan toner 1 was obtained. Its average dispersion particle diameter was 0.4 μm, and a ratio of particles having a diameter of 0.7 μm or greater was 3.5% by number.

EXAMPLE 2

A magenta master batch was prepared as follows: By using a flusher, 600 parts of water and 200 parts of a cake containing Pigment Red 57 with solid component of 50% were thoroughly agitated. To the mixture, 1,200 parts of a polyester resin (acid value: 3, hydroxyl group value: 25, Mm: 3,500, Mw/Mn: 4.0, Tg: 60° C.) was added and kneaded for 30 minutes at a temperature of 150° C., and further kneaded for 1 hours with 1,000 parts of xylene added thereto. After water and xylene were removed therefrom, the mixture was rolled and cooled, and then pulverized by a pulverizer. The mixture was further pulverized by a three-roll mill for 2 passes, and thus a magenta master batch, MB1-M, having a average particle diameter of 0.2 μm was obtained.

In example 2, a prepolymer was prepared as follows: In a reaction tank provided with a cooling pipe, an agitator, and a nitrogen introduction pipe, 856 parts of bisphenol A with 2 moles of ethylene oxide and 200 parts of isophthalic acid, 20 parts of terephthalic acid, and 4 parts of dibutyl tin oxide were reacted with each other for 6 hours at a temperature of 250° C., under normal pressure, and were further reacted for 5 hours while being dehydrated under a reduced pressure within a range of from 50 mmHg to 100 mmHg. Then, the mixture was cooled to a temperature of 160° C. and further reacted for 2 hours with 18 parts of phthalic anhydride added thereto. The mixture was then cooled to a temperature of 80° C., and further reacted with 170 parts of isophorone diisocyanate in ethyl acetate for 2 hours, and thus an isocyanate group containing prepolymer 2 having a weight average molecular weight (Mw) of 25,000 was obtained.

In the example 2, a toner was prepared as follows: In a beaker, 15.4 parts of the prepolymer 2, 50 parts of the polyester (a), and 95.2 parts of ethyl acetate were agitated and solved. Further, 10 parts of carnauba wax having a molecular weight of 1800, an acid vale of 2.5, and a needle penetration at 40° C. of 1.5 mm, and 10 parts of magenta master batch particles MB1-M were added to the mixture, and then the mixture was agitated at a temperature of 85° C. by a TK homomixer at a revolution of 10,000 rpm. Further, the mixture was pulverized by using a beads mill in a wet-pulverization process similar to the process performed in the example 1, and thus a oil-base dispersion 2 was obtained.

An aqueous dispersion liquid 2 was prepared in a method similar to the method to prepare the aqueous dispersion liquid 1, and then spherical mother toner particles 2 were obtained in a method similar to the method performed in the example 1. A toner 2 was prepared in a method similar to the method performed in the example 1 except that BONTRON E-89, also manufactured by Orient Chemical Industries Co., Ltd., was used as the charge controller instead of BONTRON E-84.

The toner 2 has an average dispersion particle diameter of 0.25 μm, and a ratio of particles having a diameter of 0.5 μm or greater was 1.0% by number.

EXAMPLE 3

In example 3, a prepolymer was prepared as follows: In a reaction tank provided with a cooling pipe, an agitator, and a nitrogen introduction pipe, 755 parts of bisphenol A with 2 moles of ethylene oxide and 195 parts of isophthalic acid, 15 parts of terephthalic acid, and 4 parts of dibutyl tin oxide were reacted with each other for 8 hours at a temperature of 220°

C., under normal pressure, and were further reacted for 5 hours while being dehydrated under a reduced pressure within a range of from 50 mmHg to 100 mmHg. Then, the mixture was cooled to a temperature of 160° C. and further reacted for 2 hours with 10 parts of phthalic anhydride added thereto. The mixture was then cooled to a temperature of 80° C., and further reacted with 170 parts of isophorone diisocyanate in ethyl acetate for 2 hours, and thus an isocyanate group containing prepolymer 3 having a weight average molecular weight (Mw) of 25,000 was obtained.

In the example 2, a toner was prepared as follows: In a beaker, 15.4 parts of the prepolymer 3, 50 parts of the polyester (a), and 95.2 parts of ethyl acetate were agitated and solved. Further, 10 parts of carnauba wax having a molecular weight of 1800, an acid vale of 2.5, and a needle penetration at 40° C. of 1.5 mm, and 15 parts of the master batch particles MB1-M, which was prepared in the example 2, were added to the mixture, and then the mixture was agitated at a temperature of 85° C. by a TK homomixer at a revolution of 14,000 rpm so as to disperse uniformly. Further, the mixture was pulverized by using a beads mill at a temperature of 15° C. for 60 minutes in a wet -pulverization process, and thus a oil-base dispersion 3 was obtained.

To prepared an aqueous dispersion liquid 3, 465 parts of ion-exchanged water, 245 parts of 10% sodium carbonate suspension liquid, and 0.4 part of dodecylbenzenesulfonate were agitated in a beaker. This aqueous dispersion liquid 3 was then heated to a temperature of 40° C. The oil-base dispersion 3 was added thereto while this aqueous dispersion liquid 3 was agitated at a revolution of 12,000 rpm by a TK homomixer, and the mixture was agitated for 10 minutes. Further, 2.7 parts of the ketimine compound 1 was reacted with the mixture. After the solvent was removed from the mixture at a temperature of 40° C. within 1 hour after the reaction, the dispersion was then filtered, washed, and dried in a method similar to the method performed in the example 2, and thus spherical mother toner particles 3 were obtained.

A toner 3 was prepared in a method similar to the method performed in the example 1 except that the mother toner particles 3 were used. The toner 3 has an average dispersion particle diameter of 0.15 μm, and a ratio of particles having a diameter of 0.5 μm or greater was 3.0% by number.

COMPARATIVE EXAMPLE 1

A comparative toner binder was prepared as follows: Using 2 parts of dibutyl tin oxide as a catalyst, 354 parts of bisphenol A with 2 moles of ethylene oxide, and 166 parts of isophthalic acid were polycondensed. The comparative toner binder 11 had a glass-transition temperature (Tg) of 57° C.

A comparative toner was prepared as follows: In a beaker, 100 parts of the comparison toner binders 11, 200 parts of ethyl acetate solution, 4 parts of copper phthalocyanine blue pigment, and 5 parts of the rice wax that was used in the example 1 were agitated by a TK homomixer at a revolution of 12,000 rpm at a temperature of 50° C., and thus a comparative dispersion liquid 11 was prepared. Except that the comparative dispersion liquid 11 was used, a comparative toner 11 was prepared in a method similar to the method used in the example 1. The comparative toner 11 had a volume average particle diameter of 6 μm. A pigment type colorant included in the comparative toner 11 had an average dispersion particle diameter of 0.70 μm, and a ratio of its particles having a diameter of 0.7 μm or greater was 35% by number.

COMPARATIVE EXAMPLE 2

A comparative toner binder was prepared as follows: In a reaction tank provided with a cooling pipe, agitator, and a nitrogen induction pipe, 343 parts of bisphenol A with 2 moles of ethylene oxide, 166 parts of isophthalic acid, and 2 parts of dibutyl tin oxide were reacted with each other at a temperature of 230° C. under a normal pressure for 8 hours, and further reacted under a reduced pressure within a range of from 10 mmHg to 15 mmHg for 5 hours. The mixture was then cooled to a temperature of 80° C., and reacted with 14 parts of toluene diisocyanate in toluene at a temperature of 110° C. for 5 hours. Solvent was removed from the mixture, and thus urethane-modified polyester having a peak-top molecular weight of 7,000 was obtained.

Further, similarly to the method performed in the example 1, 363 parts of bisphenol A with 2 moles of ethylene oxide, and 166 parts of isophthalic acid were polycondensed, and thus unmodified polyester having a peak molecular weight of 3,800 and an acid value of 7 was obtained.

In toluene, 350 parts of the urethane-modified polyester and 650 parts of the unmodified polyester were dissolved and mixed, and then solvent is removed from the mixture, and thus a comparative toner binder mother particles 12 were prepared. The comparative toner binder 12 had a glass-transition temperature (Tg) of 58° C.

A comparative toner was prepared as follows: Into 100 parts of the comparison toner binders 12, 10 parts of the master batch particles (MB1-M) and 10 parts of carnauba wax that were used in the example 2 were added. After being mixed preliminarily by a Henschel mixer, the mixture was kneaded by a continuous kneader. The mixture was then pulverized by a jet pulverizer and classified by a airstream classifier, and thus toner particles having a volume average particle diameter of 6 μm.

With 100 parts of the toner particles, 0.5 part of hydrophobic silica and 0.5 part of hydrophobized titanium oxide were mixed by a henschel mixer, and thus a comparative toner 12 was prepared. A pigment type colorant included in the comparative toner 12 had an average dispersion particle diameter of 0.70 μm, and a ratio of the particles having a diameter of 0.5 μm or greater was 15.0% by number.

The respective toners obtained above were evaluated and evaluation results are shown in FIG. 11.

Evaluation methods are described below.

The glass-transition temperature (Tg) were measured as follows: A differential scanning calorimetric system (TG-DSC), TAS-100 from RIGAKU Corp., was used in glass-transition temperature measurement. About 10 mg of a sample is put in an aluminum container, and the aluminum container was loaded on a holder unit, which was set in an electric oven. After the sample was heated in the oven from a room temperature to 150° C. at a temperature raising speed of 10° C./min and kept at this temperature for 10 minutes, the sample was cooled and kept at the room temperature for 10 minutes. The sample was heated again in a nitrogen atmosphere to a temperature of 150° C. at a temperature raising speed of 10° C./min, and then (DSC) differential scanning calorimetric measurement (DSC) of the sample was performed. The glass-transition temperature (Tg) was determined from a contact point between a heat absorption curve around the Tg and a base line using an analyzer in the TAS-100 system.

Acid value was measured according to a method specified in JIS K0070. However, when the sample was not dissolved in the solvent, dioxane or tetrahydrofuran, etc., was used.

To determined fluidity, powder density (g/ml) of the toners were measured using a Hosokawa Micron powder tester. As higher its fluidity is, the greater powder density the toner has. The evaluations are on the following four scales of:

Bad: powder density of less than 0.25 g/ml, Average: powder density within a range of from 0.25 g/ml to 0.30 g/ml Good: powder density within a range of from 0.30 g/ml to 0.35 g/ml Excellent: density of greater than 0.35 g/ml A lowest fixable temperature evaluation was performed as follows: A Ricoh MF-200 copier that uses a Teflon fixing roller was used and its fixing part was modified. In the copier, Ricoh paper 6200 was set and copying test was performed with different fixing temperatures. The resultant fixed images were rubbed with a pad, and a remaining rate of the image density (remaining image density rate) was measured. A fixing temperature was determined as a temperature with which a fixed image with a remaining image density rate of 70% or greater.

To determine a hot offset occurrence temperature, a copying test similar to the test performed in the lowest fixable temperature evaluation described above. The resultant fixed images were evaluated visually for hot offset, and a temperature of the fixing roller at which hot offset occurred was determined as the hot offset occurrence temperature.

To evaluate a gloss development temperature, a coping test was performed using a fixer of a commercial Ricoh PRETER550 copier. A temperature of its fixing roller at which images with a gloss of 10% or higher was determined as the gloss development temperature.

Haze was evaluated using HGM-2DP type of a direct-reading computer.

As it is apparent from the results shown in FIG. 11, the toners according to examples 1 through 3 can produce images in which image quality and fineness, and low temperature fixing properties and hot offset properties are balanced. By using these toners, the image forming apparatus according to the illustrative embodiment of the present invention can produced images that excel in transparency and saturation, and the gloss of such images can be controlled. Further, the toner according to the illustrative embodiment of the present invention excels in charge stability and color reproducibility.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

an image forming part which forms a toner image on a recording medium;

a fixer including a heating member and a pressure member, which transports the recording medium sandwiched therein, while fixing the toner image on the recording medium with heat and pressure;

a reverse transport part which reverses and forwards the recording medium transported from the fixer to the image forming part;

a toner image sensor which detects presence of the toner image on the recording medium;

a humidity sensor which detects humidity inside the image forming apparatus;

a first temperature sensor which detects a surface temperature of the heating member;

a second temperature sensor which detects a surface temperature of the pressure member; and a controller which controls the image forming part, the fixer, and the reverse transport part, wherein, when a glossy image formation mode is selected and no toner image is detected on the recording medium, the image forming part does not form a toner image on the recording medium, the fixer performs a first heating and pressing process and transports the recording medium to the reverse transport part, the reverse transport part transports the recording medium to the image forming part, the image forming part forms a toner image on the recording medium transported from the reverse transport part, and the fixer performs a second heating and pressing process and fixes the toner image on the recording medium, and wherein the controller controls the fixer based on the humidity inside the image forming apparatus, the surface temperature of the heating member and the surface temperature of the pressure member.

2. The image forming apparatus according to claim 1, wherein the controller sets a heating temperature in the first heating and pressing process to a temperature higher than a heating temperature in the second heating and pressing process.

3. The image forming apparatus according to claim 1, wherein the controller sets a fixing linear speed in the first heating and pressing process to a speed slower than a fixing linear speed in the second heating and pressing process.

4. The image forming apparatus according to claim 1, wherein the controller sets the surface temperatures of the heating member and the pressure member to satisfy a relation, $$Y-Z \leqq (-6.7 \times X)-150$$

wherein Y is the surface temperature of the heating member in degrees Centigrade, Z is the surface temperature of the pressure member in degrees Centigrade, and X is the humidity detected by the humidity sensor in grams per cubic meter.

5. The image forming apparatus according to claim 1, wherein, when the recording medium has a basic weight of 80 g/m$^2$ or smaller, the controller sets the surface temperatures of the heating member and the pressure member to satisfy a relation, $$Y-Z \leqq \{(-6.7 \times X)-150\} \times 0.9$$

wherein Y is the surface temperature of the heating member in degrees Centigrade, Z is the surface temperature of the pressure member in degrees Centigrade, and X is the humidity detected by the humidity sensor in grams per cubic meter.

6. The image forming apparatus according to claim 1, wherein at least one of the heating member and the pressure member is an endless belt looped around a plurality of rollers.

7. The image forming apparatus according to claim 1, wherein at least one of the heating member and the pressure member is a free nip belt.

8. The image forming apparatus according to claim 1, wherein at least one of the heating member and the pressure member is heated by electromagnetic induction heating.

9. The image forming apparatus according to claim 1, wherein, when a double-side printing mode to form toner images on both a first side and a second side of the recording medium is selected, controlled by the controller, the image forming part forms a toner image on the first side of the recording medium, the reverse transport part reverses and forwards the recording medium having the toner image fixed on the first side thereof to the image forming part, and the image forming part forms a toner image on the second side of the recording medium.

10. The image forming apparatus according to claim 1, further comprising a thickness detector which detects a thickness of the recording medium.

11. An image forming apparatus, comprising:

an image forming part configured to form a toner image on a recording medium;

a fixer including a heating member and a pressure member, configured to transport the recording medium sandwiched therein, while fixing the toner image on the recording medium with heat and pressure;

a reverse transport part configured to reverse and forward the recording medium transported from the fixer to the image forming part;

a toner image sensor configured to detect presence of the toner image on the recording medium, and a controller configured to control the image forming part, the fixer, and the reverse transport part, wherein, when a glossy image formation mode is selected and no toner image is detected on the recording medium, the image forming part does not form a toner image on the recording medium, the fixer performs a first heating and pressing process and transports the recording medium to the reverse transport part, the reverse transportpart transports the recording medium to the image forming part, the image forming part forms a toner image on the recording medium transported from the reverse transport part, and the fixer performs a second heating and pressing process and fixes the toner image on the recording medium, and wherein the toner image is formed with a toner produced through a method comprising:

forming an oil-base dispersion liquid by dissolving or dispersing, in an organic solvent, a prepolymer including a modified polyester resin, a compound with which the prepolymer performs at least one of elongation and cross-linking, and a toner component including a colorant;

inducing at least one of elongation and cross-linking of the prepolymer, the compound, and the toner component in an aqueous medium; and removing the organic solvent from the dispersion liquid, wherein the colorant dispersed in toner particles has a number average particle diameter of 0.5 μm or smaller as a dispersion particle diameter, and a ratio of colorant particles having a particle diameter of 0.7 μm or greater is not greater than 5% by number.

12. The image forming apparatus according to claim 11, wherein the toner particles have a weight average particle diameter and a number average particle diameter that satisfy a relation $$1.00 \leqq Dv/Dn \leqq 1.20$$

wherein Dv is the weight average particle diameter, Dn is the number average particle diameter, and Dv/Dn is particle diameter distribution.

13. The image forming apparatus according to claim 11, wherein the toner particles have an average circularity within a range of from 0.900 to 0.960.

14. The image forming apparatus according to claim 11, wherein the polyester resin included in the toner comprises an element that is soluble in tetrahydrofuran and has a main peak of a molecular weight distribution within a range from 2500 to 10,000, and a number average molecular weight of the element soluble in tetrahydrofuran is within a range from 2,500 to 50,000.

15. The image forming apparatus according to claim 11, wherein the polyester resin included in the toner has a glass-transition temperature within a range of from 40° C. to 65° C. and an acid number within a range of from 1 KOH mg/g to 30 KOH mg/g.

16. The image forming apparatus according to claim 11, wherein a polyester resin unreactive with amine is dissolved in the oil-base dispersion liquid.

17. The image forming apparatus according to claim 11, wherein the toner is mixed with a carrier and used in a developer.

18. The image forming apparatus according to claim 11, wherein the colorant included in the toner has a number average particle diameter of not greater than 0.3μm as a dispersion particle diameter, and a ratio of colorant particles having a particle diameter of 0.5μm or greater is not greater than 10% by number.

* * * * *